US012318827B2

(12) United States Patent
Horii et al.

(10) Patent No.: US 12,318,827 B2
(45) Date of Patent: Jun. 3, 2025

(54) ROLLING MILL, ROLLING MILL CONTROL METHOD, AND THRUST FORCE SUPPORTING METHOD IN ROLLING MILL

(71) Applicant: Primetals Technologies Japan, Ltd., Hiroshima (JP)

(72) Inventors: Kenji Horii, Hiroshima (JP); Toshihiro Usugi, Hiroshima (JP); Akihiro Yamamoto, Hiroshima (JP); Hikaru Nakaya, Hiroshima (JP); Daisuke Iwaki, Hiroshima (JP); Hiroki Yamasaki, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 423 days.

(21) Appl. No.: 17/919,362

(22) PCT Filed: Aug. 7, 2020

(86) PCT No.: PCT/JP2020/030420

§ 371 (c)(1),
(2) Date: Oct. 17, 2022

(87) PCT Pub. No.: WO2022/030004

PCT Pub. Date: Feb. 10, 2022

(65) Prior Publication Data

US 2023/0149994 A1 May 18, 2023

(51) Int. Cl.
*B21B 37/40* (2006.01)
*B21B 13/14* (2006.01)

(52) U.S. Cl.
CPC ..... *B21B 37/40* (2013.01); *B21B 13/14* (2013.01)

(58) Field of Classification Search
CPC ..... B21B 31/18; B21B 13/142; B21B 37/40
See application file for complete search history.

(56) References Cited

U.S. PATENT DOCUMENTS

2003/0097866 A1* 5/2003 Hiura ..... B21B 31/18 72/247

FOREIGN PATENT DOCUMENTS

| | | | |
|---|---|---|---|
| EP | 2772321 | A1 | 9/2014 |
| JP | 7-144210 | A | 6/1995 |
| JP | 52-3557 | A | 1/1997 |

(Continued)

OTHER PUBLICATIONS

Translation of JP-4434339-B2 (Year: 2010).*
International Search Report of PCT/JP2020/030420 dated Oct. 13, 2020.

*Primary Examiner* — Bobby Yeonjin Kim
(74) *Attorney, Agent, or Firm* — MATTINGLY & MALUR, PC

(57) ABSTRACT

Provided are: an upper work roll, radial bearings and a thrust bearing provided on a work side and a drive side of the upper work roll and supporting the upper work roll. Shift cylinders are provided on the work side of the upper work roll and apply forces in both a work side direction and a drive side direction to the thrust bearing. Shift cylinders are also provided on the drive side of the upper work roll and apply forces in both the work side direction and the drive side direction to the radial bearing 790B. The shift cylinders each apply a force in the same direction to the radial bearing and the thrust bearing when the upper work roll does not shift in an axial direction at least during rolling.

12 Claims, 15 Drawing Sheets

(56) References Cited

FOREIGN PATENT DOCUMENTS

| | | | | |
|---|---|---|---|---|
| JP | 2001-001012 | A | 1/2001 | |
| JP | 4434339 | B2 * | 3/2010 | ..... B21B 13/145 |
| JP | 2011-025299 | A | 2/2011 | |

* cited by examiner

ROLLING MILL, ROLLING MILL CONTROL METHOD, AND THRUST FORCE SUPPORTING METHOD IN ROLLING MILL

TECHNICAL FIELD

The present invention relates to a rolling mill, a rolling mill control method, and a thrust force supporting method in the rolling mill.

BACKGROUND ART

As an example of a rolling mill having a work roll shift function, which is capable of rolling a high-quality rolled material without a transfer flaw on a surface thereof by suppressing the occurrence of abrasion flaws on work rolls, which are caused by both end portions in the width direction of the rolled material, when controlling an edge drop of the rolled material by shifting the work rolls in the axial direction of the work rolls, the work rolls having one end formed in a tapered shape, Patent Document 1 describes a reversing rolling mill including: a pair of upper and lower work rolls that have, at one ends of roll barrel portions, tapered portions having a roll diameter gradually decreased toward a roll end, and sandwich the rolled material such that the tapered portions are located on opposite sides from each other in the axial direction; and roll shift devices that shift the work rolls in the axial direction, the surfaces of the roll barrel portions in the work rolls being formed of a ceramic material or a cemented carbide material.

PRIOR ART DOCUMENT

Patent Document

Patent Document 1: JP-2011-25299-A

SUMMARY OF THE INVENTION

Problem to be Solved by the Invention

Studies for reducing the diameter of the work rolls have been progressing. However, since bearings of the work rolls also become smaller with a reduction in diameter of the work rolls, parts receiving thrust forces of the work rolls also become smaller, and thus a capability of supporting the thrust forces becomes insufficient.

For example, Patent Document 1 discloses a structure in which shift driving units are provided on both a drive side and an operation side of the work rolls, and the work rolls sandwiched by both the shift driving units are shifted in the axial direction.

However, in the structure of Patent Document 1 described above, the shift driving unit on the operation side only pushes the work rolls to the drive side, and the shift driving unit on the drive side only pushes the work rolls to the operation side, so that only one shift driving unit contributes when supporting a thrust force. Therefore, studies by the present inventor et al. have clarified that there is room for improvement in sufficiently supporting the thrust force in work rolls of a small diameter, in particular.

The present invention provides a rolling mill, a rolling mill control method, and a thrust force supporting method in the rolling mill that can improve the capability of supporting the thrust force.

Means for Solving the Problems

The present invention includes a plurality of means for solving the above-described problems. To cite an example of the means, there is provided a rolling mill including: a work roll; bearings that are provided on an operation side and a drive side of the work roll, and support the work roll; an operation side thrust force supporting device that is provided on the operation side of the work roll, and applies forces in both directions of the operation side and the drive side to the bearing on the operation side; and a drive side thrust force supporting device that is provided on the drive side of the work roll, and applies forces in both directions of the operation side and the drive side to the bearing on the drive side; the operation side thrust force supporting device and the drive side thrust force supporting device each applying a force in a same direction to the bearing when the work roll is not shifted in an axial direction at least during rolling.

Advantages of the Invention

According to the present invention, the capability of supporting the thrust force can be improved. Problems, configurations, and effects other than those described above will be made apparent by description of the following embodiments.

MODES FOR CARRYING OUT THE INVENTION

Figure 1:
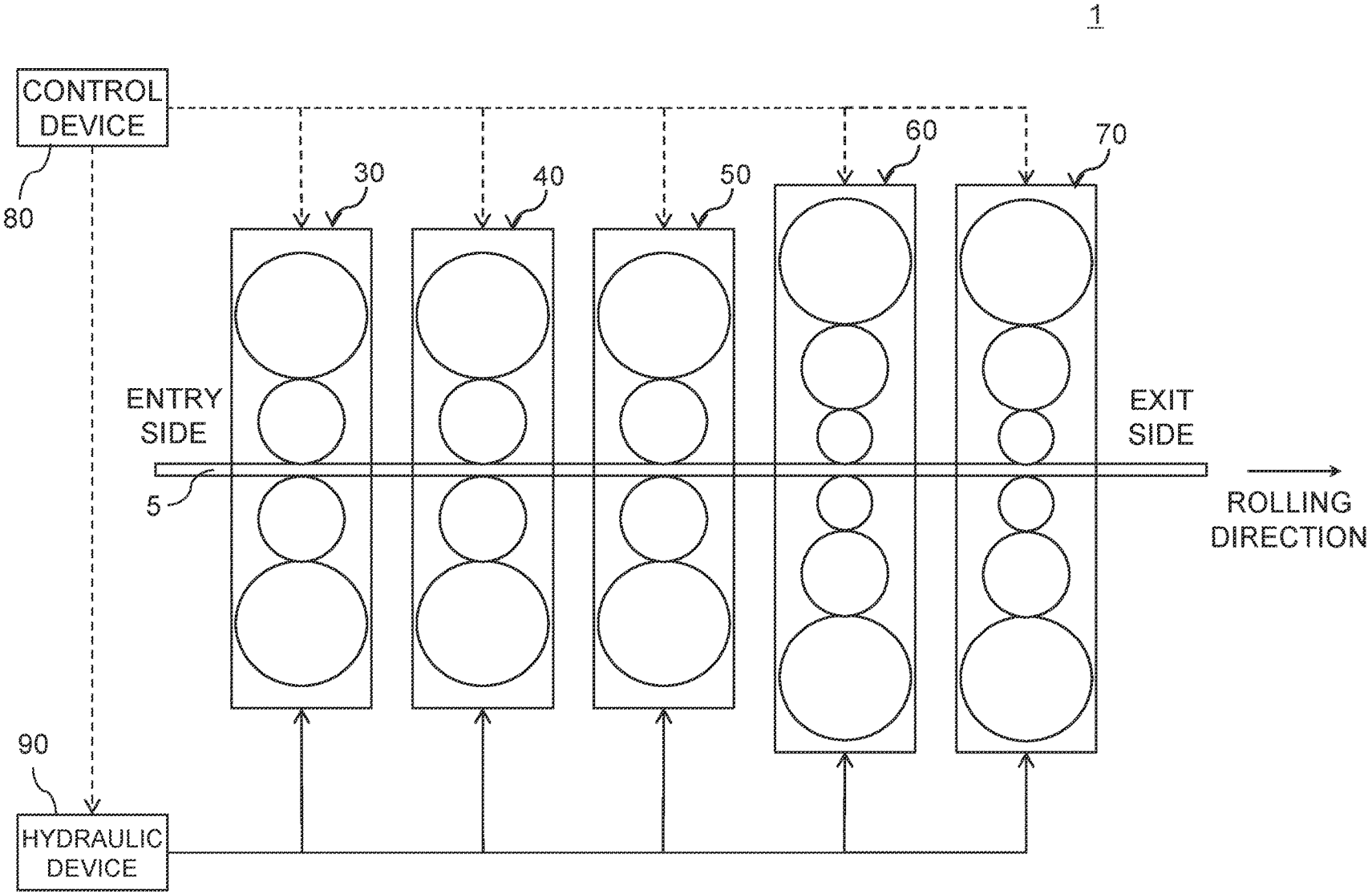
FIG. 1 is a diagram showing an outline of rolling equipment including rolling mills according to a first embodiment of the present invention.

Embodiments of a rolling mill, a rolling mill control method, and a thrust force supporting method in the rolling mill according to the present invention will hereinafter be described with reference to the drawings.

In the following, same or corresponding constituent elements in the drawings used in the present specification are identified by the same or similar reference numerals, and repeated description of these constituent elements may be omitted.

In addition, in the drawings, a work side may be denoted as "WS (Work Side)," and a drive side may be denoted as "DS (Drive Side)."

Further, a thrust resistance force is a force in a roll axis direction, which acts on each roll of the rolling mill and a bearing housing thereof during rolling or when a shift is performed during rolling, and which means a force acting on devices supporting the force, and has the same meaning as a thrust force. A thrust reaction force is a force occurring from the devices supporting the thrust resistance force, and means a force having an opposite direction from that of the thrust resistance force and having a same magnitude as that of the thrust resistance force.

First Embodiment

Figure 2:
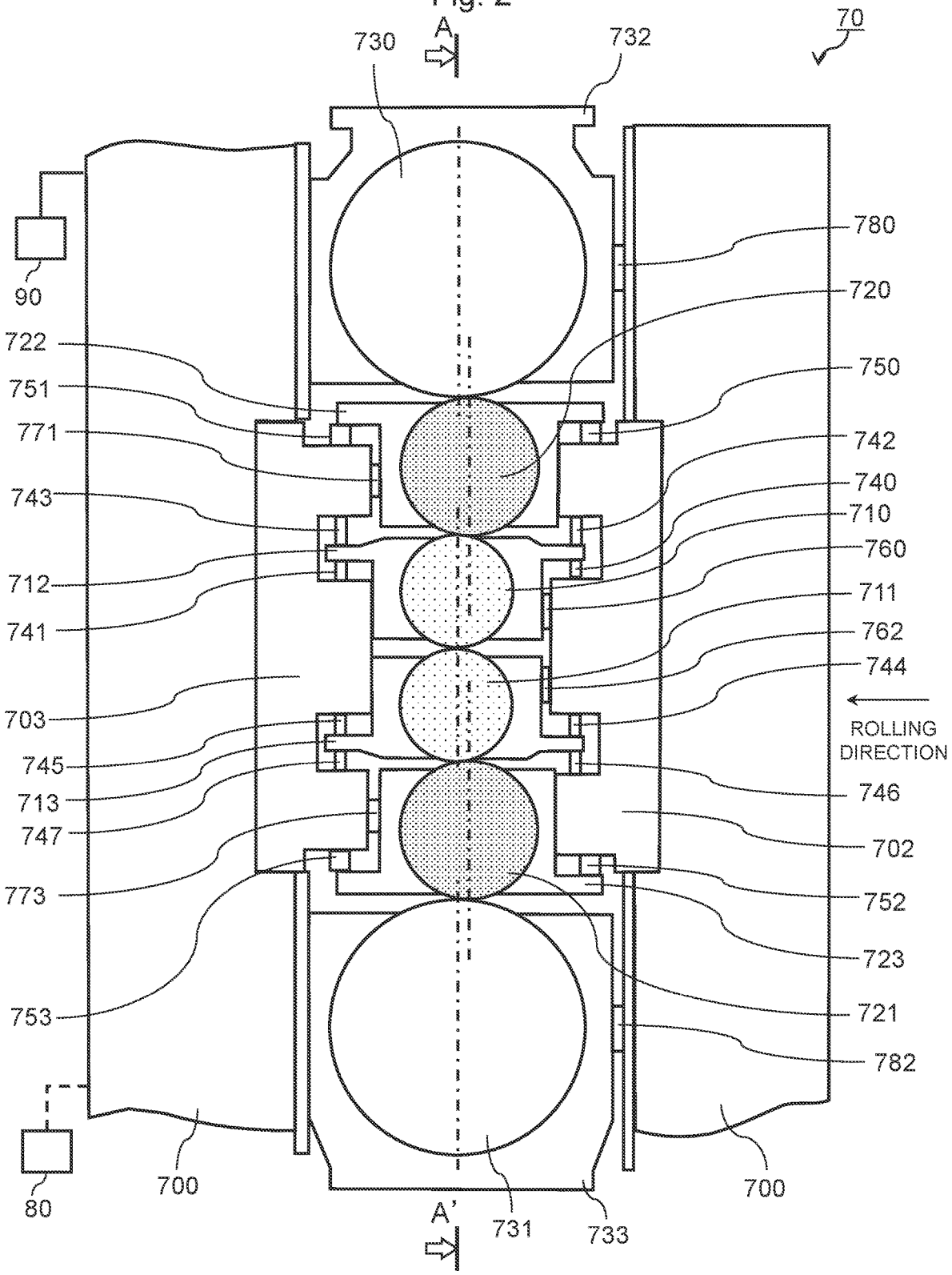
FIG. 2 is a front view of assistance in explaining an outline of a rolling mill according to the first embodiment.
Figure 3:
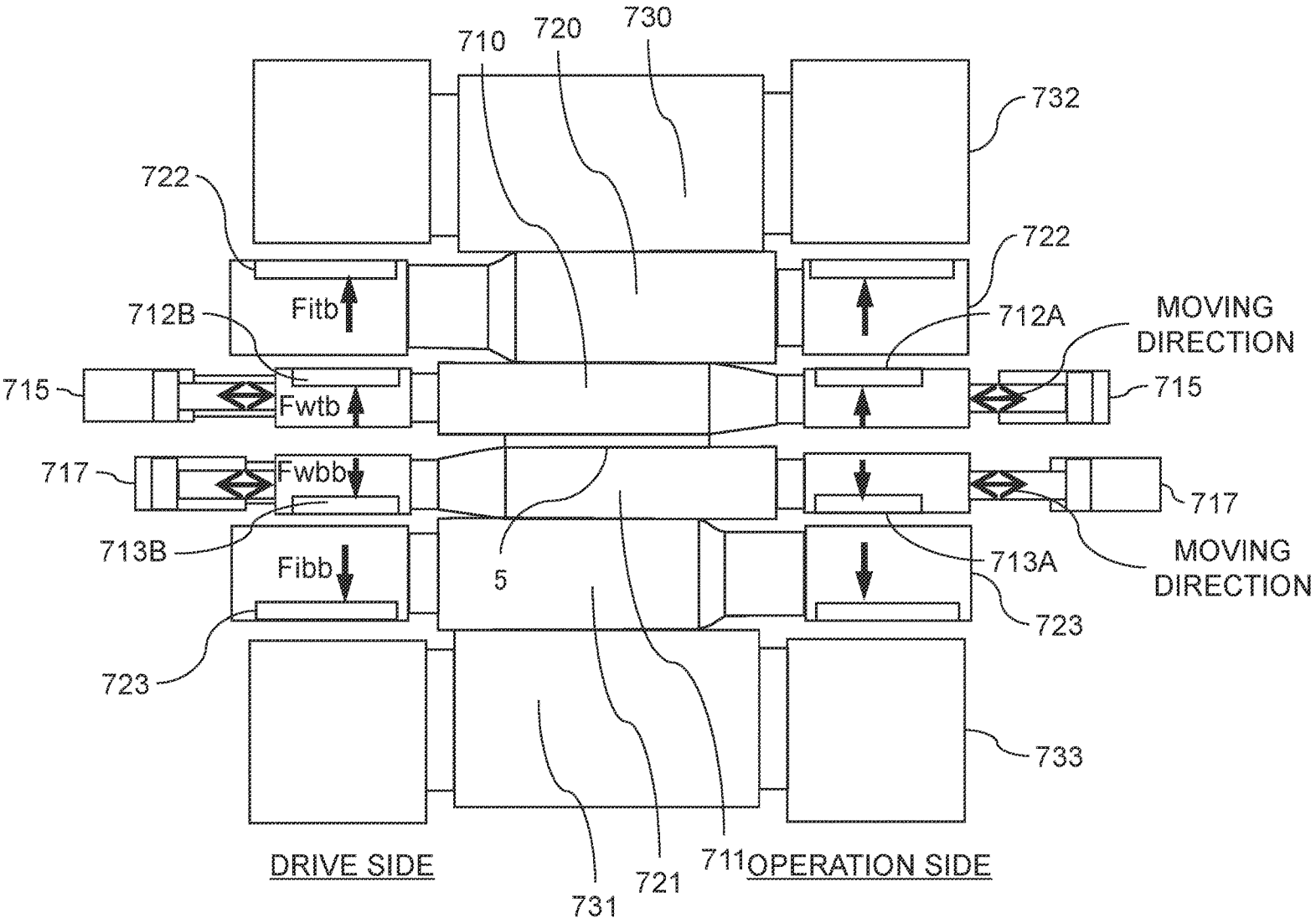
FIG. 3 is a view taken in the direction of arrows along a line A-A' in FIG. 2.
Figure 4:
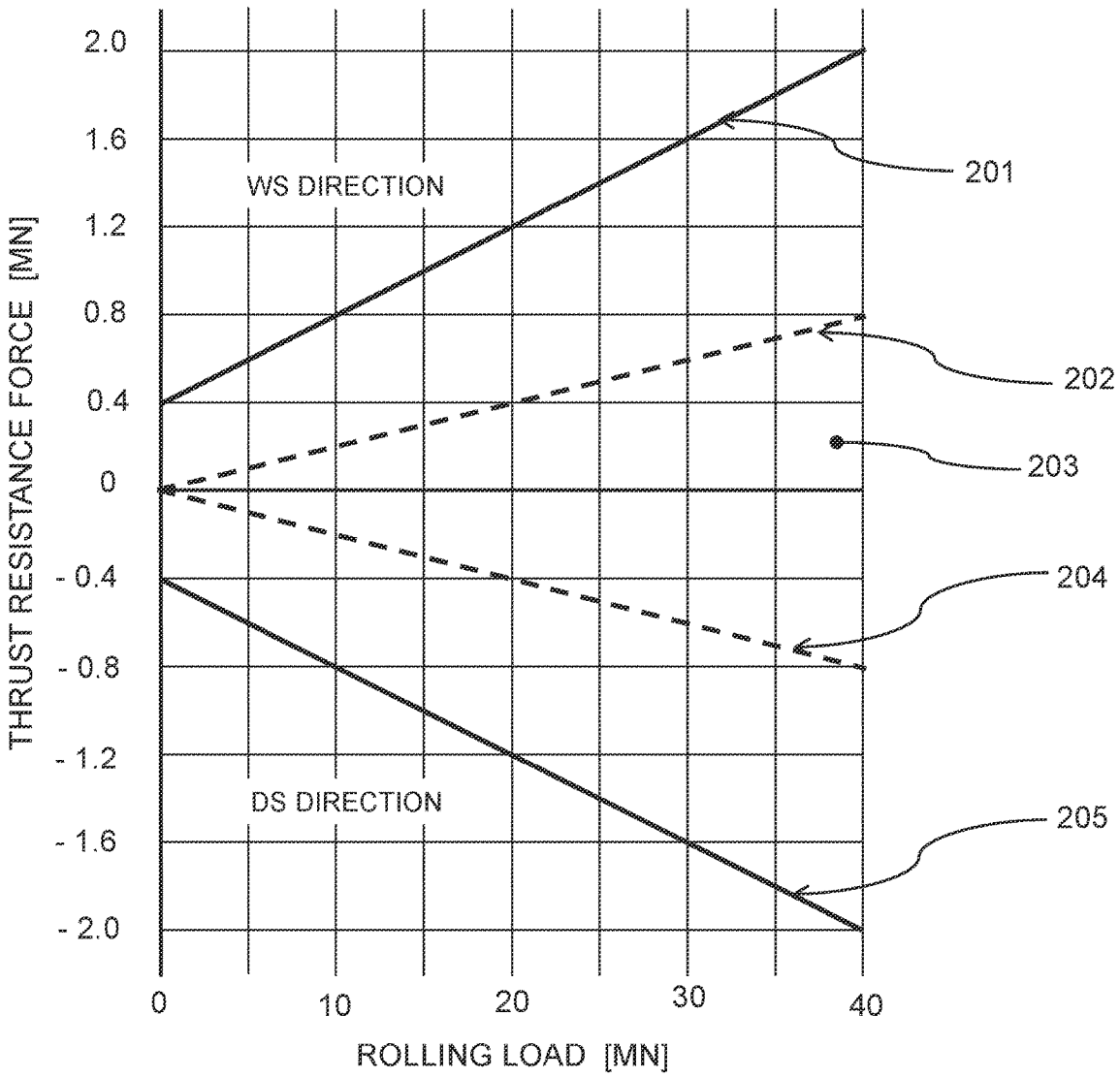
FIG. 4 is a diagram showing relation between a rolling load and a thrust resistance force.
Figure 5:
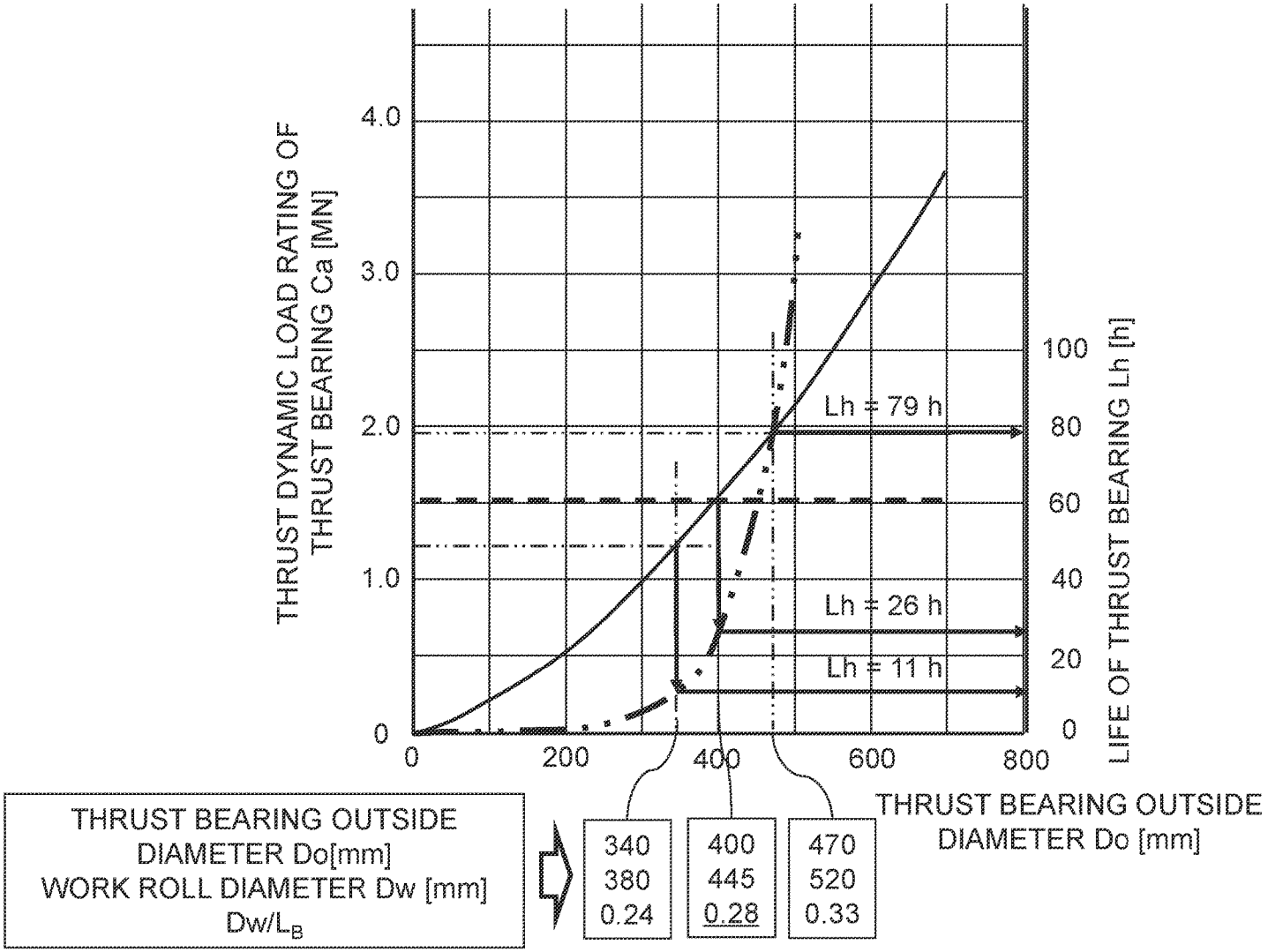
FIG. 5 is a diagram showing relation between an outside diameter of a thrust bearing, a thrust dynamic load rating of the thrust bearing, and a life of the thrust bearing.
Figure 6:
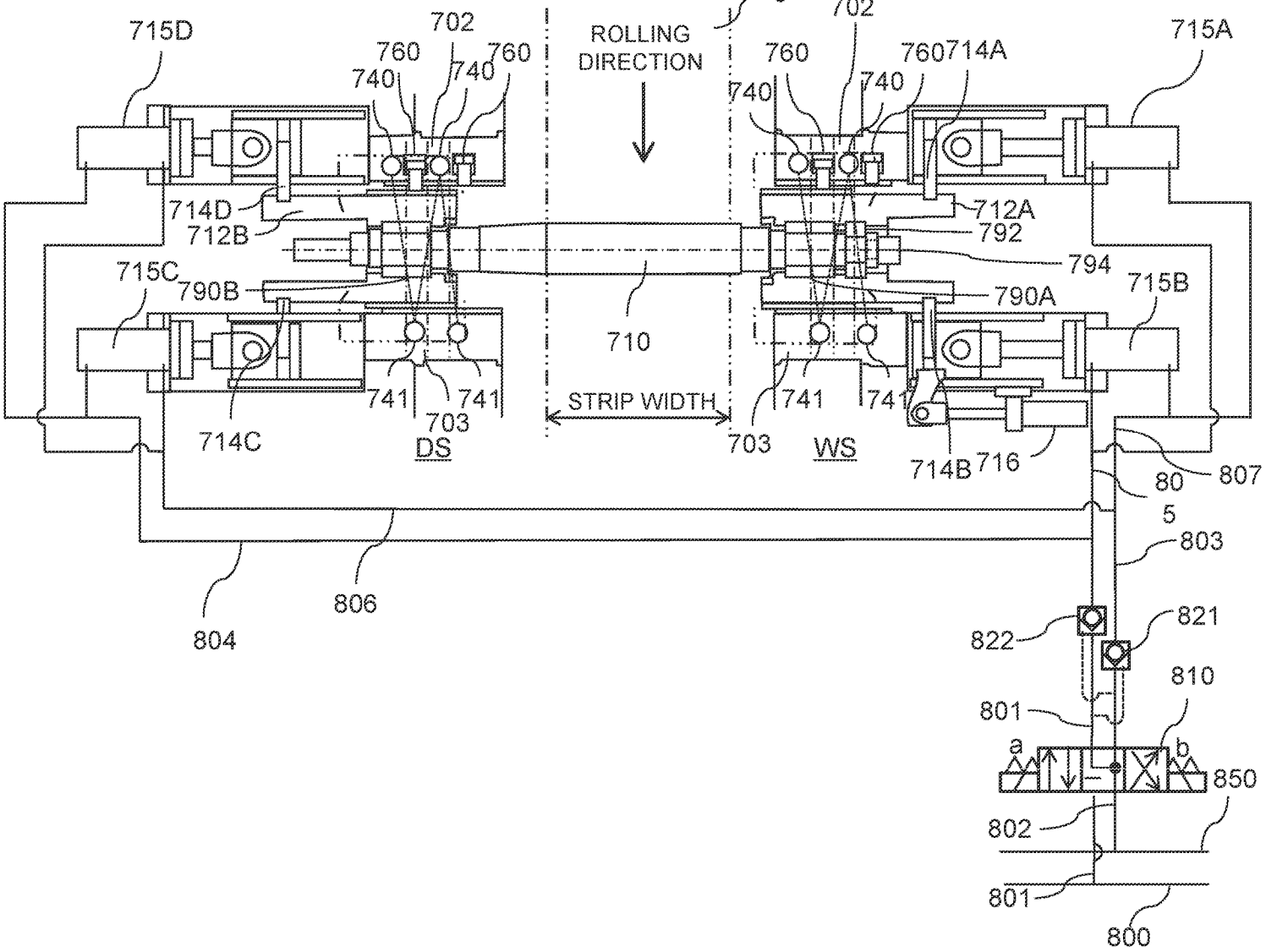
FIG. 6 is a plan view of assistance in explaining details of an upper work roll part in the rolling mill according to the first embodiment.

A first embodiment of the rolling mill, the rolling mill control method, and the thrust force supporting method in the rolling mill according to the present invention will be described with reference to FIGS. 1 to 6. FIG. 1 is a diagram showing an outline of rolling equipment including rolling mills according to the present first embodiment. FIG. 2 is a front view of assistance in explaining an outline of a rolling mill according to a first embodiment. FIG. 3 is a view taken in the direction of arrows along a line A-A' in FIG. 2. FIG. 4 is a diagram showing relation between a rolling load and a thrust resistance force. FIG. 5 is a diagram showing relation between an outside diameter of a thrust bearing and a thrust dynamic load rating of the thrust bearing. FIG. 6 is a plan view of assistance in explaining details of an upper work roll part.

An outline of rolling equipment including rolling mills according to the present embodiment will first be described with reference to FIG. 1.

As shown in FIG. 1, the rolling equipment 1 includes a plurality of rolling mills that hot roll a rolled material 5 into a strip, and the rolling equipment 1 includes a control device 80 and five stands, which are, from an entry side of the rolled material 5, a first stand 30, a second stand 40, a third stand 50, a fourth stand 60, and a fifth stand 70.

Of these, each of the first stand 30, the second stand 40, the third stand 50, the fourth stand 60, and the fifth stand 70 and a part that controls each stand in the control device 80 correspond to a rolling mill as referred to in the present invention.

Incidentally, the rolling equipment 1 is not limited to the five stands as shown in FIG. 1, but can be constituted of a minimum of two stands or more.

A part of an outline of the rolling mill according to the present invention will next be described with reference to FIG. 2. It is to be noted that while description will be made by taking the fifth stand 70 shown in FIG. 1 as an example in FIG. 2, the rolling mill according to the present invention can be applied to any of the first stand 30, the second stand 40, the third stand 50, and the fourth stand 60 shown in FIG. 1.

In FIG. 2, the fifth stand 70 as a rolling mill according to the present embodiment is a six-high rolling mill that rolls the rolled material 5, and the fifth stand 70 includes a housing 700, the control device 80, and a hydraulic device 90.

The housing 700 includes an upper work roll 710 and a lower work roll 711 as well as an upper intermediate roll 720 and a lower intermediate roll 721 that support the upper work roll 710 and the lower work roll 711 by being in contact with the upper work roll 710 and the lower work roll 711, respectively. The housing 700 further includes an upper back-up roll 730 and a lower back-up roll 731 that support the upper intermediate roll 720 and the lower intermediate roll 721 by being in contact with the upper intermediate roll 720 and the lower intermediate roll 721, respectively.

A radial bearing 790A and a thrust bearing 792 (see FIG. 6 for both) that shift together with the upper work roll 710 in the axial direction of the roll and receive a load from the roll are provided on the operation side of end portions in the axial direction of the upper work roll 710 among these rolls. The radial bearing 790A and the thrust bearing 792 are supported by an upper work side bearing housing 712A. Similarly, a radial bearing 790B (see FIG. 6) that shifts together with the upper work roll 710 in the axial direction of the roll and receives a load from the roll is provided on the drive side. This radial bearing 790B is supported by an upper drive side bearing housing 712B.

The lower work roll 711 is also similarly provided with bearings (omitted for the convenience of illustration) at end portions thereof in the axial direction on each of the drive side and the operation side. These bearings are supported by a lower work roll bearing housing 713 (a bearing housing 713A on the operation side and a bearing housing 713B on the drive side).

In the present embodiment, the upper work roll 710 is configured to be shiftable in the roll axis direction by a shift cylinder 715 as shown in FIG. 3 via the upper work side bearing housing 712A on the operation side. Similarly, the lower work roll 711 is also configured to be shiftable in the roll axis direction by a shift cylinder 717 as shown in FIG. 3 via the lower work roll bearing housing 713A on the operation side.

In addition, as shown in FIG. 3, a tapered portion is provided to end portions on the operation side in the upper work roll 710 and the lower intermediate roll 721 and end portions on the drive side in the lower work roll 711 and the upper intermediate roll 720. The upper work roll 710 and the lower work roll 711 are vertically point-symmetric to each other, and the upper intermediate roll 720 and the lower intermediate roll 721 are vertically point-symmetric to each other.

Returning to FIG. 2, an entry side fixed member 702 is fixed to the housing 700 on the entry side of the rolled material 5. An exit side fixed member 703 is fixed to the housing 700 on an exit side of the rolled material 5 so as to face the entry side fixed member 702.

In the fifth stand 70, as shown in FIG. 2 and FIG. 6, on each of the operation side and the drive side, the upper work roll bearing housing 712 is supported by upper work roll bending cylinders 740 and 742 provided in twos in the axial direction of the roll to the entry side fixed member 702 and upper work roll bending cylinders 741 and 743 provided in twos in the axial direction of the roll to the exit side fixed member 703.

A bending force is applied in a vertical direction to the bearings of the upper work roll 710 by driving these cylinders as appropriate.

Similarly, on each of the operation side and the drive side, the lower work roll bearing housing 713 is supported by lower work roll bending cylinders 744 and 746 provided to the entry side fixed member 702 and lower work roll bending cylinders 745 and 747 provided to the exit side fixed member 703. A bending force is applied in the vertical direction to the bearings of the lower work roll 711 by driving these cylinders as appropriate.

Of these cylinders, the upper work roll bending cylinders 740 and 741 are arranged so as to apply a bending force on a vertical direction increase side (in a direction opposite from a rolled material side) to the bearings of the upper work roll 710 in contact with the rolled material 5. In addition, the upper work roll bending cylinders 742 and 743 are arranged so as to apply, to the bearings, a bending force on a vertical direction decrease side (in a rolled material side direction) as an opposite direction from that of the upper work roll bending cylinders 740 and 741.

Similarly, the lower work roll bending cylinders 744 and 745 are arranged so as to apply a bending force on the vertical direction increase side to the bearings of the lower work roll 711 in contact with the rolled material 5. In addition, the lower work roll bending cylinders 746 and 747 are arranged so as to apply, to the bearings, a bending force on the decrease side as an opposite direction from that of the lower work roll bending cylinders 744 and 745.

Further, as shown in FIG. 2 and FIG. 6, with an objective of removing backlash, the entry side fixed member 702 on the entry side of the rolled material 5 is provided with two upper work roll bearing housing backlash removing cylinders 760 in the axial direction of the roll to apply a force in a horizontal direction, specifically a pressing force in a rolling direction to the upper work roll 710 via a liner (not shown) of the upper work roll bearing housing 712.

Similarly, the entry side fixed member 702 is provided with two lower work roll bearing housing backlash removing cylinders 762 to apply a pressing force in the rolling direction to the lower work roll 711 via a liner of the lower work roll bearing housing 713.

These cylinders enable desired forces to be applied to the upper work roll 710 and the like in directions orthogonal to the roll axis direction.

Returning to FIG. 2, bearings (not shown) are provided to end portions in the axial direction of the upper intermediate roll 720 on each of the drive side and the operation side. These bearings are supported by an upper intermediate roll bearing housing 722. The lower intermediate roll 721 is also similarly provided with bearings (not shown) at end portions thereof in the axial direction on each of the drive side and the operation side. These bearings are supported by a lower intermediate roll bearing housing 723.

The upper intermediate roll 720 has the upper intermediate roll bearing housing 722 supported on each of the operation side and the drive side by upper intermediate roll bending cylinders 750 provided to the entry side fixed member 702 and upper intermediate roll bending cylinders 751 provided to the exit side fixed member 703. A bending force is applied on the vertical direction increase side to the bearings by driving these cylinders as appropriate.

The lower intermediate roll 721 also has the lower intermediate roll bearing housing 723 supported on each of the operation side and the drive side by lower intermediate roll bending cylinders 752 provided to the entry side fixed member 702 and lower intermediate roll bending cylinders 753 provided to the exit side fixed member 703. A bending force is applied on the vertical direction increase side to the bearings by driving these cylinders as appropriate.

In addition, as shown in FIG. 2, the housing 700 on the exit side is provided with an upper intermediate roll bearing housing backlash removing cylinder 771 to apply a force in the horizontal direction to the upper intermediate roll 720 via the upper intermediate roll bearing housing 722. Similarly, the housing 700 on the exit side is provided with a lower intermediate roll bearing housing backlash removing cylinder 773 to apply a force in the horizontal direction to the lower intermediate roll 721 via the lower intermediate roll bearing housing 723.

Further, bearings (not shown) are provided to end portions in the axial direction of the upper back-up roll 730 on each of the drive side and the operation side. These bearings are supported by an upper back-up roll bearing housing 732. The lower back-up roll 731 is also similarly provided with bearings (not shown) at end portions thereof in the axial direction on each of the drive side and the operation side. These bearings are supported by a lower back-up roll bearing housing 733.

In addition, as shown in FIG. 2, the housing 700 on the entry side is provided with an upper back-up roll bearing housing backlash removing cylinder 780 to apply a force in the horizontal direction to the upper back-up roll 730 via the upper back-up roll bearing housing 732. Similarly, the housing 700 on the entry side is provided with a lower back-up roll bearing housing backlash removing cylinder 782 to apply a force in the horizontal direction to the lower back-up roll 731 via the lower back-up roll bearing housing 733.

A hydraulic device 90 is connected to hydraulic cylinders such as the bending cylinders and the backlash removing cylinders described above, the shift cylinders 715 and 717, rolling cylinders (not shown) that apply a rolling force for rolling the rolled material 5 to the upper work roll 710 and the lower work roll 711, or the like. This hydraulic device 90 is connected to the control device 80.

The control device 80 supplies and discharges hydraulic fluid to and from the above-described bending cylinders or the like by performing operation control on the hydraulic device 90. The control device 80 thereby performs driving control on each of these cylinders.

Characteristic parts of the rolling mill, the control method thereof, and the thrust force supporting method in the present invention will next be described with reference to FIG. 6 by taking as an example a configuration related to the upper work roll 710 among the rolls of the fifth stand 70. Incidentally, the lower work roll 711 can adopt a configuration and a method similar to those of the upper work roll 710 and has substantially the same detailed configuration as the upper work roll 710, and therefore description thereof will be omitted.

A background that led to introduction of a configuration shown in FIG. 6 will first be described with reference to FIG. 4 and FIG. 5.

First, in the present invention, it can be assumed that letting $D_w$ be the diameter of the upper work roll 710 and the lower work roll 711, and letting $L_B$ be a maximum rolling strip width of the rolled material, the upper work roll 710 and the lower work roll 711 satisfy a condition that $D_w/L_B$ is 0.28 or less.

When the work rolls of such a relatively small diameter are used, the size of the radial bearings and the thrust bearings is limited because of limitations in the vertical direction on the work roll bearing housings, and large bearings cannot be used. In addition, spaces in the vertical direction for the shift cylinders are also reduced, and the shift cylinders cannot be formed as large devices. The bearings themselves become small and decrease in strength in the first place. Therefore, even when devices related to shifts can be made large, the life of the bearings presents a major problem.

FIG. 4 is a diagram showing relation between a rolling load and a thrust resistance force. An axis of abscissas indicates the rolling load [MN]. An axis of ordinates indicates the thrust resistance force [MN]. "−" on the axis of ordinates indicates a drive side direction. "+" on the axis of ordinates indicates a work side direction.

As shown in FIG. 4, a straight line 202 indicating a work side direction maximum value of the thrust resistance force when no shift is performed during rolling is substantially equal to Rolling Load×0.02. In addition, a straight line 204 indicating a drive side direction maximum value of the thrust resistance force when no shift is performed during rolling is substantially equal to minus Rolling Load×0.02. A thrust resistance force 203 when no shift is performed during rolling is larger than minus Rolling Load×0.02, and is smaller than Rolling Load×0.02.

This thrust load occurs due to a fact that the axes of the upper work roll 710 and the upper intermediate roll 720 slightly cross each other between the rolls and a fact that the axis of the upper work roll 710 slightly crosses the width direction (direction at a right angle to a travelling direction) of the rolled material 5. The direction of the thrust load may be the drive side direction, or may be the work side direction.

On the other hand, when a shift is performed during rolling, slip resistance between the rolls, which changes according to a ratio between a shift speed and a rolling speed, frictional resistance in a shift direction of forces acting on the bearing housings, extension or contraction resistance of driving spindles (frictional resistance of tangential forces acting on splines due to driving torque), and the like further act as the thrust resistance force. The forces acting on the bearing housings are bending forces and backlash removing cylinder forces as well as an offset component force of the rolling load due to a pass direction offset between the rolls and the like.

Therefore, a straight line 201 indicating a work side direction maximum value of the thrust resistance force when a shift is performed during rolling is located on a positive side of the straight line 202, and a straight line 205 indicating a drive side direction maximum value of the thrust resistance force when a shift is performed during rolling is located on a negative side of the straight line 204.

Incidentally, the straight lines 201 and 205 shown in FIG. 4, which indicate the maximum values of the thrust resistance force when a shift is performed during rolling, are represented by solid lines by linear approximation. This linear approximation is not accurate because rolling torque and the rolling load are not in linear relation, but is used as one approximation for facilitating the description.

In addition, the bending forces and the backlash removing cylinder forces are set in a manner not too closely related to the rolling load. Thus, there is a thrust resistance force even when the rolling load is 0 [MN].

As shown in FIG. 4, when the rolling load exceeds 20 [MN], a thrust resistance force equal to or more than twice the thrust force at a time of a rolling load of 40 [MN] in a case where no shift is performed during rolling acts in a case where a shift is performed during rolling.

In addition, in a case where a shift is performed during rolling, a thrust resistance force close to a maximum value of the thrust resistance force at a time of a rolling load of 40 [MN] in a case where no shift is performed during rolling acts on an average even when the rolling load is small at 20 [MN] or less.

Further, in a rolling mill with a rolling load max of 40 [MN], a thrust resistance force 3.0 times that in a case where no shift is performed during rolling acts on an average when a shift is performed during rolling.

FIG. 5 is a diagram showing relation between an outside diameter Do [mm] of a thrust bearing, a thrust dynamic load rating Ca [MN] of the thrust bearing, and a life Lh [h] of the thrust bearing.

Here, a case is assumed in which when the rolling load max is 40 [MN] and the thrust resistance force max is 2.0 [MN], 75% of the thrust resistance force max is an average thrust load. In this case, an average thrust load Fa is about 2.0×0.75=1.5 [MN].

Incidentally, even when equipment specifications of the rolling mill represent equipment with a rolling load of 40 [MN], the rolling load of 40 [MN] does not always act. The rolling load is determined by a rolling schedule including a strip width, a rolling reduction, and the like, and it is obvious that the average thrust load Fa differs in different equipment.

As shown in FIG. 5, the thrust dynamic load rating Ca when the outside diameter Do is 470 [mm] is 2.0 [MN], and the thrust dynamic load rating Ca when Do is 340 [mm] is 1.2 [MN]. The thrust dynamic load rating Ca is thus decreased to 60%.

As for a lifetime number of revolutions Lhr of a bearing, a relation $Lhr \propto (Ca/Fa)^{10/3}$ is known. In a case where the outside diameter Do becomes 340 [mm], the lifetime number of revolutions is decreased to 1/5.5 as compared with a case where the outside diameter Do is 470 [mm] even when the average thrust load Fa is the same.

When the diameter $D_w$ of the work roll is reduced, the outside diameter Do of the thrust bearing becomes small. For example, it is assumed that Do is about 470 [mm] when $D_w$=520 [mm], and that Do is about 340 [mm] when $D_w$=380 [mm].

In this case, it is understood that the lifetime number of revolutions of the bearing is decreased to 1/5.5=18% when $D_w$ is reduced to 73%, and that a significant decrease in the life of the bearing is unavoidable.

For example, supposing that the maximum rolling strip width $L_B$ of the rolled material is 1600 [mm], the life Lh [h] of the thrust bearing at a rolling speed of 900 [m/min] and a rolling load of 40 [MN] is as follows.

When Do=470 [mm], $D_w$=520 [mm], and $D_w/L_B$=0.33, Ca=2.0 [MN], Fa=1.5 [MN], and Lh=79 [h]. When Do=400 [mm], $D_w$=445 [mm], and $D_w/L_B$=0.28, Ca=1.5 [MN], Fa=1.5 [MN], and Lh=26 [h]. When Do=340 [mm], $D_w$=380 [mm], and $D_w/L_B$=0.24, Ca=1.2 [MN], Fa=1.5 [MN], and Lh=11 [h].

When $D_w$ becomes a smaller diameter while the rolling speed is the same, the number of revolutions is increased, and therefore the life is shortened more than a decrease in the lifetime number of revolutions. Here, in a case where $D_w/L_B$=0.28, there is a condition of Ca=Fa, and the life Lh of the thrust bearing in this case is 26 [h]. In actual operation, the work roll is replaced a few times a day. However, it is obvious that the life of the bearing is reached in a very short time. Even when operation is performed while a few sets of bearings are retained, the bearing reaches a life in one week at most. Thus, the thrust bearing can be said to have a limit in actual equipment from both viewpoints of operation and equipment maintenance. When $D_w/L_B=0.24$, Lh=11 [h]. Then, it is uncertain when damage is caused during operation, and the thrust bearing can be said to be inapplicable in actual equipment.

In such a rolling mill in which a work roll of a small diameter is used and, in particular, a shift is performed during rolling, the life of the bearing with respect to the thrust load on the work roll becomes a problem. In a conventional system in which only either the work side or the drive side is provided with a shift device, a problem of a short life occurs in the case of a work roll of a small diameter even though the life of the bearing is not a problem in the case of a conventional work roll of a relatively large diameter. Further, even when rolling is continued without a shift being performed during rolling, a thrust load always acts during rolling. Thus, the life of the bearing with respect to the thrust load presents a problem of a short life in the case of a work roll of a small diameter.

The present inventor et al. accordingly have conceived decreasing the average thrust load Fa. Conventionally, the shift device is disposed only on either the work side or the drive side. However, this shift device is provided also to the drive side or the work side, and the thrust resistance force is supported by the shift devices on both the work side and the drive side also when no shift is performed during rolling. Consequently, the average thrust load Fa can be basically halved by supporting the thrust resistance force on the work side and the drive side. When Fa can be halved, the lifetime number of revolutions can be extended by 10 times because the lifetime number of revolutions Lhr has the relation $Lhr \propto (Ca/Fa)^{10/3}$. Incidentally, load allocation between the work side and the drive side can be selected, and is not particularly limited.

The present invention has been made on the basis of such findings.

Characteristic configurations and control of the present invention will next be described.

As shown in FIG. 6, the entry side fixed member 702 on the operation side is provided with a shift cylinder 715A that applies forces in both directions of the work side and the drive side to the upper work roll 710 via a connecting member 714A connected to the upper work side bearing housing 712A that supports the radial bearing 790A and the thrust bearing 792 on the work side.

In addition, the exit side fixed member 703 on the operation side is provided with a shift cylinder 715B that applies forces in both directions of the work side and the drive side to the upper work roll 710 via a connecting member 714B connected to the upper work side bearing housing 712A that supports the radial bearing 790A and the thrust bearing 792 on the work side.

The part of this shift cylinder 715B is provided with a position sensor 716 that senses the position in the roll axis direction of the upper work roll 710. Incidentally, the position at which the position sensor 716 is provided is not limited to this, but may be the position of another shift cylinder 715A, 715C, or 715D. In addition, the position sensor does not need to be one position sensor, but two or more position sensors can be provided.

Similarly, the entry side fixed member 702 on the drive side is provided with a shift cylinder 715D that applies forces in both directions of the work side and the drive side to the upper work roll 710 via a connecting member 714D connected to the upper drive side bearing housing 712B that supports the radial bearing 790B on the drive side.

In addition, the exit side fixed member 703 on the drive side is provided with a shift cylinder 715C that applies forces in both directions of the work side and the drive side to the upper work roll 710 via a connecting member 714C connected to the upper drive side bearing housing 712B that supports the radial bearing 790B on the drive side.

A force in the axial direction, which acts on the upper work roll 710, acts on the thrust bearing 792 provided only to the work side, and is ultimately supported by the shift cylinders 715A and 715B on the work side. Similarly, the force in the axial direction, which acts on the upper work roll 710, acts on the radial bearing 790B on the drive side, and the force is supported by the shift cylinders 715C and 715D on the drive side.

The force in the axial direction, which acts on the upper work roll 710, may be the work side direction, or may be the drive side direction. Thus, both of the shift cylinders 715A and 715B on the work side and the shift cylinders 715C and 715D on the drive side can support the force in each of the work side direction and the drive side direction.

Hence, in both a case where a shift is performed during rolling and a case where no shift is performed during rolling, the force in the axial direction, which acts on the upper work roll 710, can be supported by a total of the work side and the drive side.

These shift cylinders 715A, 715B, 715C, and 715D have a cylinder slid by an inflow or an outflow of oil into or from each of a head side space and a rod side space. The rod side space of each of the shift cylinders 715A and 715B on the work side and the shift cylinders 715C and 715D on the drive side is disposed on a side close to the rolled material 5.

Here, the thrust reaction force is a sum of one force on a head side, which is a side pushing the upper work roll 710, and another force on a rod side, which is a side pulling the upper work roll 710.

In addition, the upper work roll 710 has a high load capability against being pushed. On the other hand, a thrust force transmitting member 794 is fitted to a part that transmits a pulling force to the upper work roll 710. However, the diameter of the upper work roll 710 side at the part provided with the thrust force transmitting member 794 is narrowed. The load capability of the upper work roll 710 against the pulling force therefore depends on the strength of the part of the narrow diameter. Thus, the load capability against the pulling force is lower than the load capability against being pushed.

In the shift cylinders 715A, 715B, 715C, and 715D, output power on the head side is higher than on the rod side. Thus, as shown in FIG. 6, the pushing side is set as the head side, and the pulling side is set as the rod side, so that the force of pushing the upper work roll 710 can be made larger than the force of pulling the upper work roll 710.

The thrust bearing 792 and the radial bearing 790A are disposed in the upper work side bearing housing 712A. The radial bearing 790B is disposed in the upper drive side bearing housing 712B.

Forces of the upper work roll bending cylinders 740 and 741 and the upper work roll bearing housing backlash removing cylinders 760 act on the radial bearings 790A and 790B among these bearings. These radial bearings 790A and 790B support these forces in the perpendicular directions, which act on the roll shaft, while the radial bearings 790A and 790B rotate.

The radial bearing 790B on the drive side also supports the force in the axial direction, which acts on the upper drive side bearing housing 712B. Thus, a four-row tapered roller bearing is generally used as the radial bearing 790B. In addition, bearings of the same specifications are used as the radial bearing 790B on the drive side and the radial bearing 790A on the work side, so that complication of maintenance work can be avoided.

On the other hand, a double-row tapered roller bearing or the like is generally used as the thrust bearing 792 provided only to the work side. Reasons for providing the thrust bearing 792 only to the work side are as follows.

A shaft end on the drive side of the upper work roll 710 is coupled to a driving spindle (not shown). A driving torque acts on a roll shaft end portion, and therefore a torsion acts on the roll. There is thus a desire to increase the shaft diameter as much as possible. Here, when a configuration in which a thrust bearing is disposed also on the drive side is adopted, the shaft diameter is decreased, and the driving torque that can be transmitted is limited.

Therefore, the drive side is not provided with a thrust bearing, but is provided with only the radial bearing 790B, so that the shaft diameter of the drive side shaft end portion of the upper work roll 710 is increased. Accordingly, the radial bearing 790B on the drive side receives both the roll bending force and the thrust reaction force. Then, as for a method of receiving the forces on the work side and the drive side, the forces can be increased on the work side, for example.

A driving system of the shift cylinders 715A, 715B, 715C, and 715D is provided with a solenoid selector valve 810 that regulates inflow/outflow amounts of oil on the exit sides of a pressure line 801 branched from a pressure line 800 through which the hydraulic fluid delivered from a pump (not shown) of the hydraulic device 90 flows and a tank line 802 branched from a tank line 850 connected to a tank (not shown) that stores the hydraulic fluid.

When the solenoid selector valve 810 is a-energized, the rod sides of the shift cylinders 715A and 715B on the work side are connected to the pressure line 800, so that a force in the work side direction acts on the thrust bearing 792, and the head sides of the shift cylinders 715C and 715D on the drive side are connected to the pressure line 800, so that a force in the work side direction acts on the radial bearing 790B. Then, the head sides of the shift cylinders 715A and 715B on the work side and the rod sides of the shift cylinders 715C and 715D on the drive side are connected to the tank line 850. The shift cylinders 715A, 715B, 715C, and 715D on each of the work side and the drive side thereby produce a shift force in the work side direction.

In addition, when the solenoid selector valve 810 is b-energized, the head sides of the shift cylinders 715A and 715B on the work side are connected to the pressure line 800, so that a force in the drive side direction acts on the thrust bearing 792, and the rod sides of the shift cylinders 715C and 715D on the drive side are connected to the pressure line 800, so that a force in the drive side direction acts on the radial bearing 790B. Then, the rod sides of the shift cylinders 715A and 715B on the work side and the head sides of the shift cylinders 715C and 715D on the drive side are connected to the tank line 850. The shift cylinders 715A, 715B, 715C, and 715D on each of the work side and the drive side thereby produce a shift force in the drive side direction.

With the configuration of the solenoid selector valve 810 and the energization control of the control device 80, the shift cylinders 715C and 715D apply a force of pulling to the drive side to the radial bearing 790B when the shift cylinders 715A and 715B apply a force of pushing to the drive side to the thrust bearing 792, and the shift cylinders 715A and 715B apply a force of pulling to the work side to the thrust bearing 792 when the shift cylinders 715C and 715D apply a force of pushing to the work side to the radial bearing 790B.

Here, the head sides of the shift cylinders 715A, 715B, 715C, and 715D have higher output power than the rod sides thereof, and therefore the pushing force of each cylinder is larger than the pulling force thereof. When the upper work roll 710 is shifted in the drive side direction, load assignments received by the rod sides of the shift cylinders 715C and 715D on the drive side are made smaller than those of the head sides of the shift cylinders 715A and 715B on the work side. When the upper work roll 710 is shifted in the work side direction, load assignments received by the rod sides of the shift cylinders 715A and 715B on the work side are made smaller than those of the head sides of the shift cylinders 715C and 715D on the drive side. The pushing forces applied by the shift cylinders 715A and 715B or the shift cylinders 715C and 715D can be thereby made larger than the pulling forces.

Consequently, on the drive side, a resultant force of torsional stress caused by the driving torque and tension caused by a shift can be reduced. In particular, the thrust bearing 792 is present on the work side, and therefore a shaft end of the roll is particularly thin. Thus, the life of the shaft end of the roll can be lengthened by reducing the tension caused by a shift, which acts on the shaft end of the roll.

A pilot check valve 822 is provided to the pressure line 801 on the downstream side of the solenoid selector valve 810. A pilot check valve 821 is provided to a pressure line 803 on the downstream side of the solenoid selector valve 810. The hydraulic fluid is prevented from flowing to both the rod sides and the head sides of the shift cylinders 715A, 715B, 715C, and 715D when the solenoid selector valve 810 becomes neutral. Consequently, even when the shifting of the upper work roll 710 is stopped, the upper work roll 710 is supported by the shift cylinders 715A and 715B on the work side and the shift cylinders 715C and 715D on the drive side so as not to move in the axial direction.

On the downstream side of the pilot check valve 822 in the pressure line 801, the pressure line 801 is branched into a drive side head side pressure line 804 connected to the head sides of the shift cylinders 715C and 715D on the drive side and a work side rod side pressure line 805 connected to the rod sides of the shift cylinders 715A and 715B on the work side.

Similarly, on the downstream side of the pilot check valve 821 in the pressure line 803, the pressure line 803 is branched into a drive side rod side pressure line 806 connected to the rod sides of the shift cylinders 715C and 715D on the drive side and a work side head side pressure line 807 connected to the head sides of the shift cylinders 715A and 715B on the work side.

In such a hydraulic circuit, the control device 80 drives the hydraulic device 90 such that the shift cylinders 715A, 715B, 715C, and 715D each apply a force in a same direction to the radial bearing 790B and the thrust bearing 792 so as to support a thrust force when the upper work roll 710 is not shifted in the axial direction at least during rolling.

The control device 80 regulates the solenoid selector valve 810 on the basis of the position of the upper work roll 710, which is measured by the position sensor 716.

Further, preferably, the control device 80 makes shifts of the upper work roll 710 performed in one direction during rolling, and makes the moving directions of the two facing rolls opposite from each other. Consequently, the life of the rolls and the bearings can be lengthened even in a case of a severe load condition where rolling is continued for a long time, and slight shifts continue to occur one after another during the rolling.

Incidentally, the hydraulic system of FIG. 6 represents only parts for describing the present invention, and relief valves, flow control valves, check valves, and the like are added as appropriate when desired. For example, for a reason of elongation of the work roll due to thermal expansion, a change in the direction of the thrust force acting on the roll set, or the like, an excessive pressure may occur within coupled pipes of the head sides on the work side and the rod sides on the drive side or within coupled pipes of the rod sides on the work side and the head sides on the drive side. In order to deal with an excessive load at the time, relief valves are provided between the pilot check valves 821 and 822 and the shift cylinders 715A, 715B, 715C, and 715D, and a pressure increase within the pipes is thereby held to an allowable pressure of the machine.

Effects of the present embodiment will next be described.

In the rolling mill according to the foregoing first embodiment of the present invention, the shift cylinders 715A, 715B, 715C, and 715D each apply a force in a same direction to the radial bearing 790B and the thrust bearing 792 when the upper work roll 710 is not shifted in the axial direction at least during rolling. The shift cylinders 715A, 715B, 715C, and 715D on both sides can thereby receive a thrust force from the upper work roll 710 in a distributed manner even in a case where no shift is performed during rolling. Thus, a large thrust force can be supported even in a case where a work roll of a relatively small diameter is used.

In addition, also when the upper work roll 710 is shifted, the force can be distributed to the shift cylinders 715A, 715B, 715C, and 715D on both the operation side and the drive side. In particular, the present embodiment can counteract the load of the thrust force, exposure thereto continuing for a long time, during normal operation, and is suitable for improving the life of the radial bearing 790B, the thrust bearing 792, and the like.

In addition, the shift cylinders 715A, 715B, 715C, and 715D are controlled such that the shift cylinders 715C and 715D apply a force of pulling to the drive side to the radial bearing 790B when the shift cylinders 715A and 715B apply a force of pushing to the drive side to the thrust bearing 792, and the shift cylinders 715A and 715B apply a force of pulling to the work side to the thrust bearing 792 when the shift cylinders 715C and 715D apply a force of pushing to the work side to the radial bearing 790B. Thus, operation timings in which the shift cylinders 715A, 715B, 715C, and 715D on the work side and the drive side push and pull can be synchronized. The thrust force can therefore be distributed with high accuracy.

Further, the pushing forces applied by the shift cylinders 715A and 715B or the shift cylinders 715C and 715D are made larger than the pulling forces. Thus, even when a problem of a reduced diameter occurs at a shaft end part of the upper work roll 710, the roll life can be lengthened by distributing the forces such that the pushing forces are made larger than the pulling forces.

In addition, the shift cylinders 715A, 715B, 715C, and 715D have a cylinder slid by an inflow or an outflow of oil into or from each of the head side space and the rod side space. The following are further provided: the pressure lines 801 and 803 into or from which the oil flows; the tank line 850; the drive side head side pressure line 804; the work side rod side pressure line 805; the drive side rod side pressure line 806; the work side head side pressure line 807; the position sensor 716 that senses the position of the upper work roll 710; and the solenoid selector valve 810 that is provided to the pressure lines 801 and 803, and regulates the inflow/outflow amount of the oil. The control device 80 is further provided which regulates the solenoid selector valve 810 on the basis of the position of the upper work roll 710, which is measured by the position sensor 716. Thus, the upper work roll 710 can be shifted while the force is distributed to the shift cylinders 715A, 715B, 715C, and 715D on both the operation side and the drive side.

Further, the rod side space of each of the shift cylinders 715A and 715B on the work side and the shift cylinders 715C and 715D on the drive side is disposed on a side close to the rolled material. Thus, for the upper work roll 710 having a higher load capability against being pushed than a load capability against a pulling force, the pushing side providing high output power can be disposed on the head side, and the pulling side can be disposed on the rod side providing lower output power than the head side. A more reasonable arrangement relation can therefore be set.

In addition, letting $D_w$ be the diameter of the upper work roll 710, and letting $L_B$ be a maximum rolling strip width of the rolled material, the upper work roll 710 satisfies a condition that $D_w/L_B$ is 0.28 or less. Consequently, a steel strip harder than conventional can be rolled with a conventional work roll diameter or less, and more complex shape control can be performed.

Figure 7:
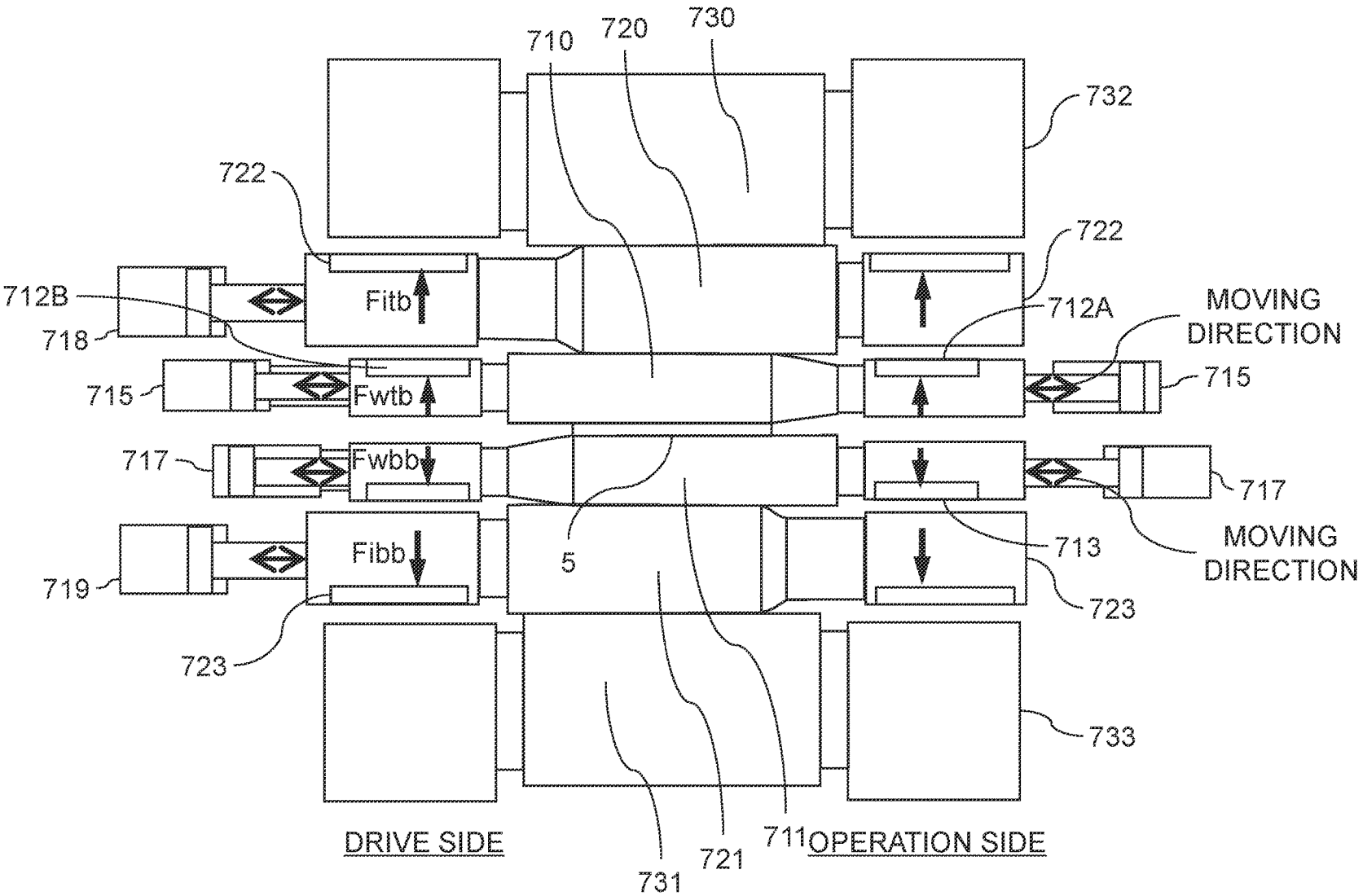
FIG. 7 is a plan view of assistance in explaining a part taken in the direction of arrows along the line A-A' in FIG. 2 in a rolling mill according to a first modification of the first embodiment.
Figure 8:
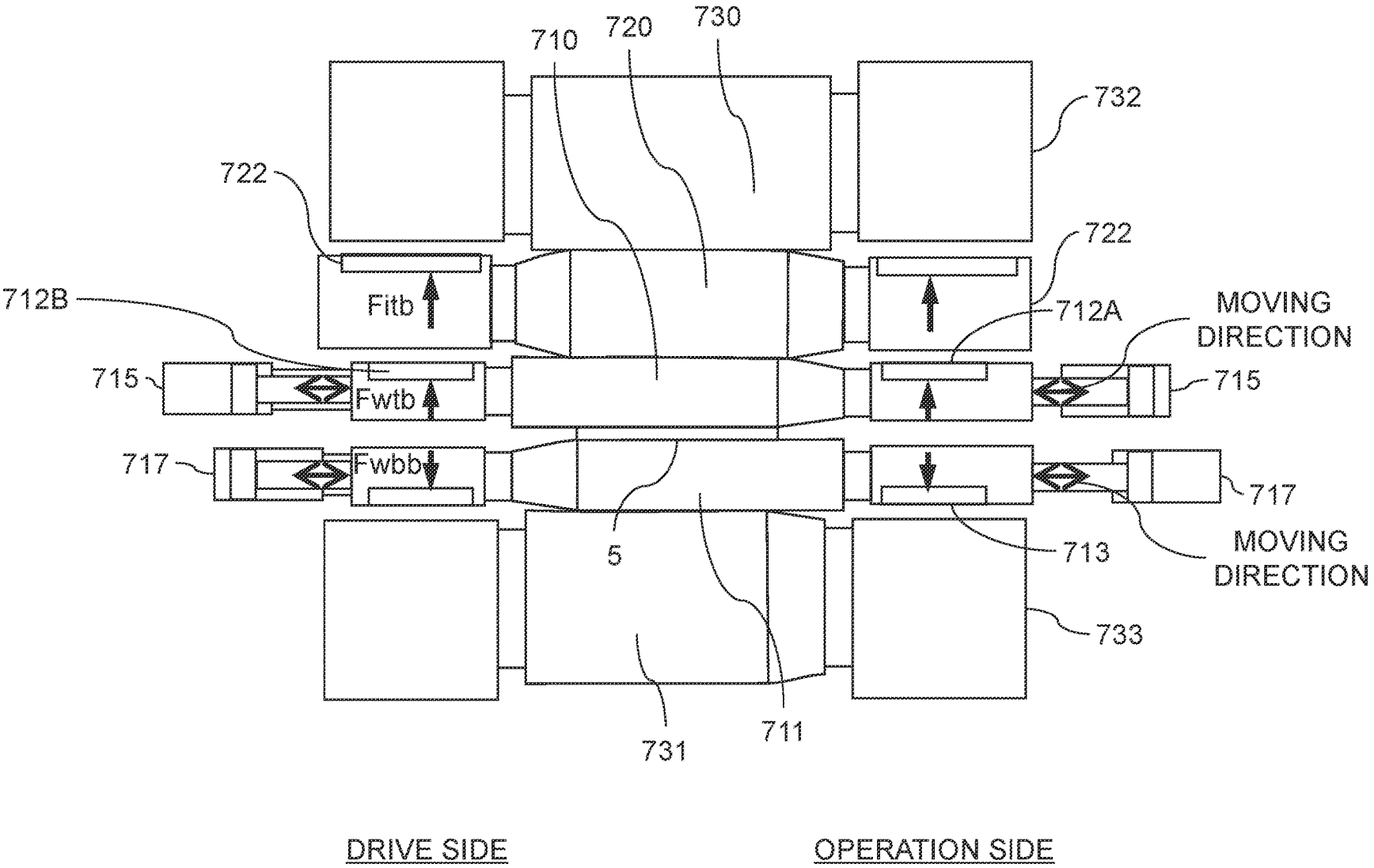
FIG. 8 is a plan view of assistance in explaining a part taken in the direction of arrows along the line A-A' in FIG. 2 in a rolling mill according to a second modification of the first embodiment.
Figure 9:
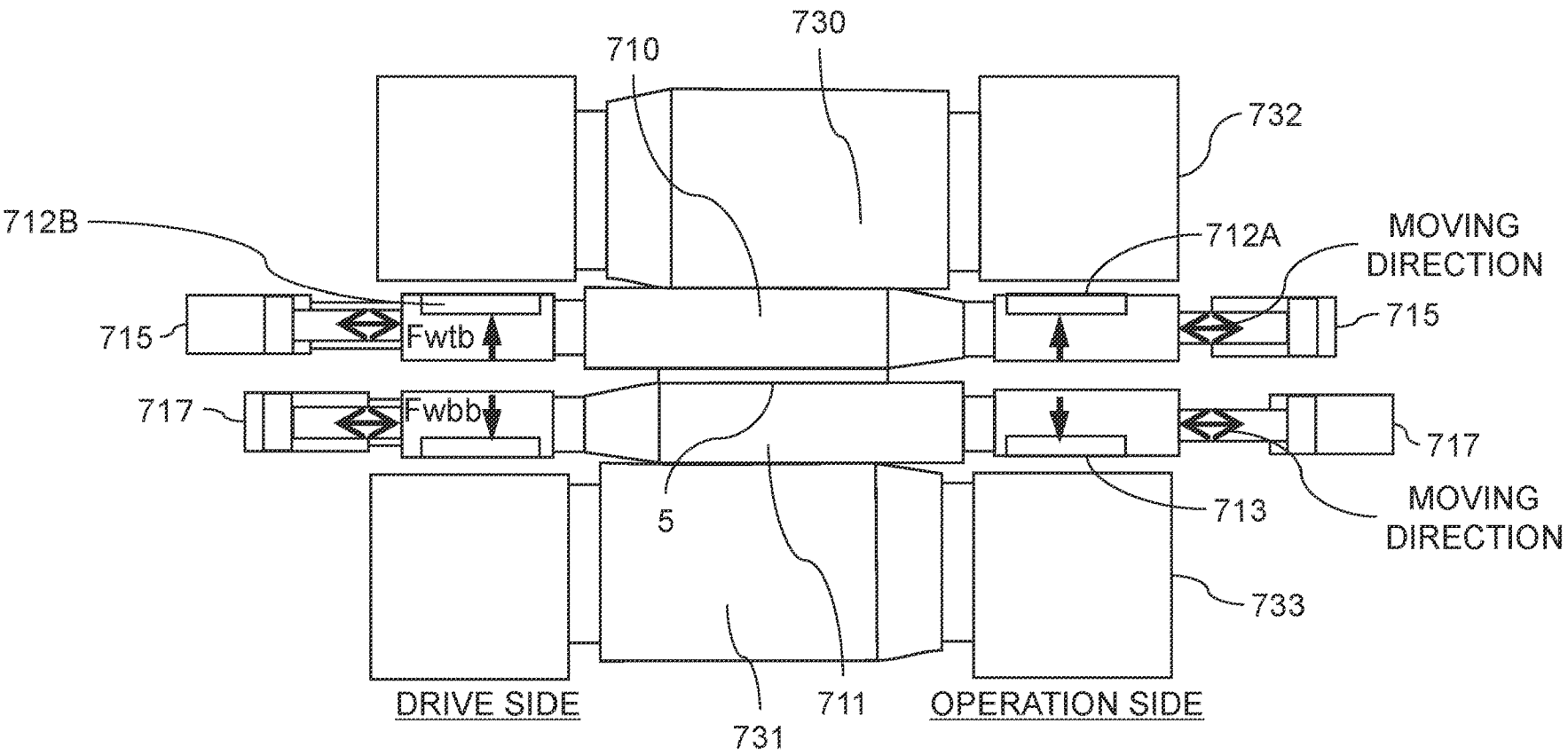
FIG. 9 is a plan view of assistance in explaining a part taken in the direction of arrows along the line A-A' in FIG. 2 in a rolling mill according to a third modification of the first embodiment.

It is to be noted that the configuration of the rolling mill according to the present embodiment is not limited to the form shown in FIG. 2 and the like. Other forms will be described in the following with reference to FIGS. 7 to 9. FIGS. 7 to 9 are plan views of assistance in explaining the part taken in the direction of arrows along the line A-A' in FIG. 2 in rolling mills according to modifications of the first embodiment.

In the rolling mill shown in FIG. 7, the shift cylinders 715 of the upper work roll 710 and the shift cylinders 717 of the lower work roll 711 are provided, and a shift cylinder 718 of the upper intermediate roll 720 and a shift cylinder 719 of the lower intermediate roll 721 are provided.

In the rolling mill shown in FIG. 8, the shift cylinders 715 of the upper work roll 710 and the shift cylinders 717 of the lower work roll 711 are provided, and only the upper intermediate roll 720 is provided. Incidentally, a form can be adopted in which only the lower intermediate roll 721 is provided in place of the form shown in FIG. 8.

In the rolling mill shown in FIG. 9, a form is adopted in which the upper intermediate roll 720 and the lower intermediate roll 721 are not provided, but the upper back-up roll 730 directly supports the upper work roll 710, and the lower back-up roll 731 directly supports the lower work roll 711. These correspond to the first stand 30, the second stand 40, and the third stand 50 shown in FIG. 1.

In addition, the above-described rolling mills can adopt a configuration in which at least the upper work roll 710 and the lower work roll 711 can cross each other during rolling. In particular, in the rolling mill in which the upper work roll 710 and the lower work roll 711 cross each other during rolling, the thrust force acting on the upper work roll 710 and the lower work roll 711 is increased. Even when the upper work roll 710 and the lower work roll 711 are shifted in such a rolling mill, the provision of the shift cylinders 715 and 717 on both the work side and the drive side can reduce shift forces on at least one side, and lengthen the life of various kinds of constituent members constituting the rolling mill, such as the bearings, the rolls, and the like. In addition, a configuration can be adopted in which the upper intermediate roll 720 and the lower intermediate roll 721 can cross each other.

Second Embodiment

Figure 10:
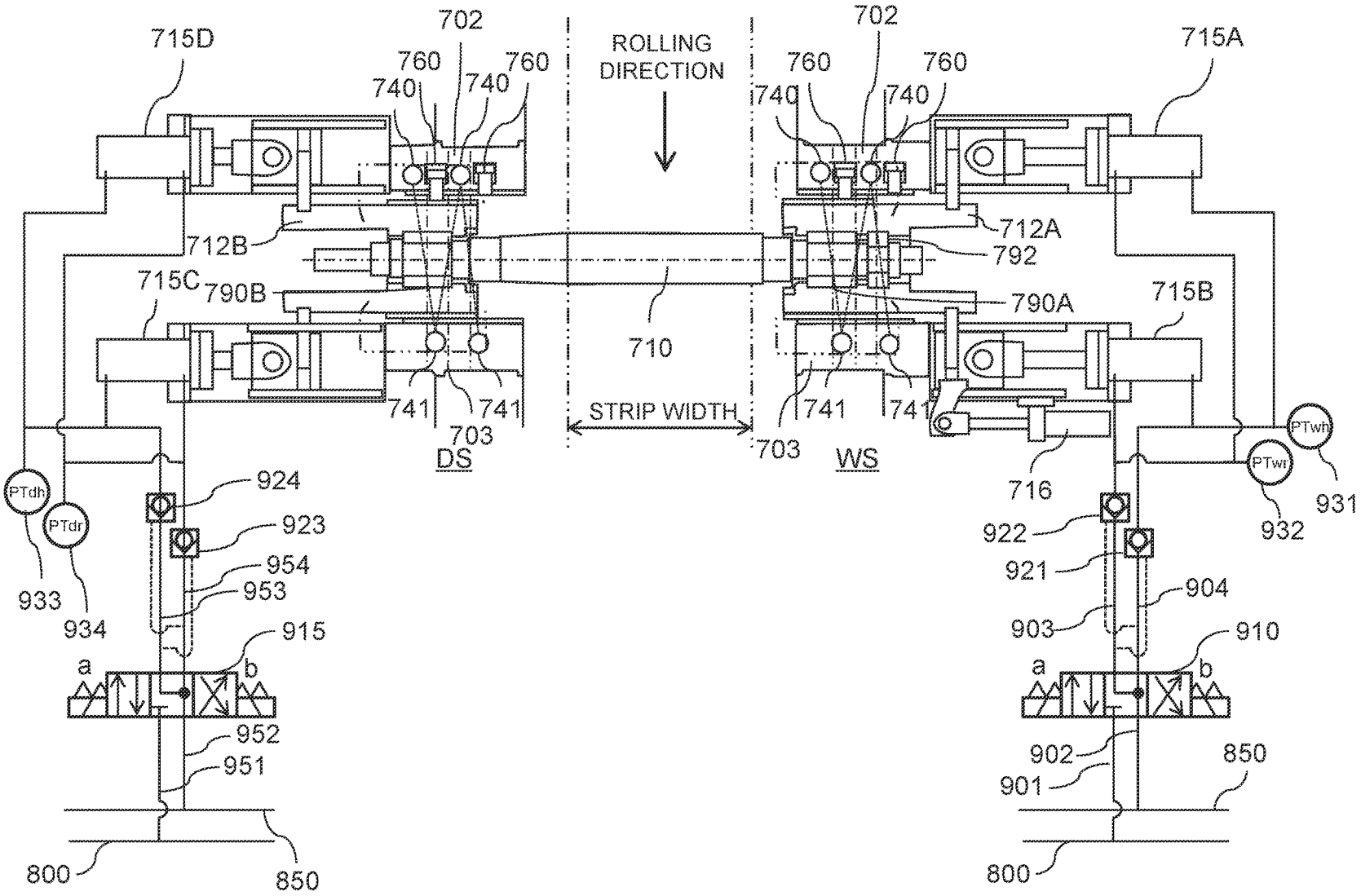
FIG. 10 is a plan view of assistance in explaining details of an upper work roll part in a rolling mill according to a second embodiment of the present invention.
Figure 11:
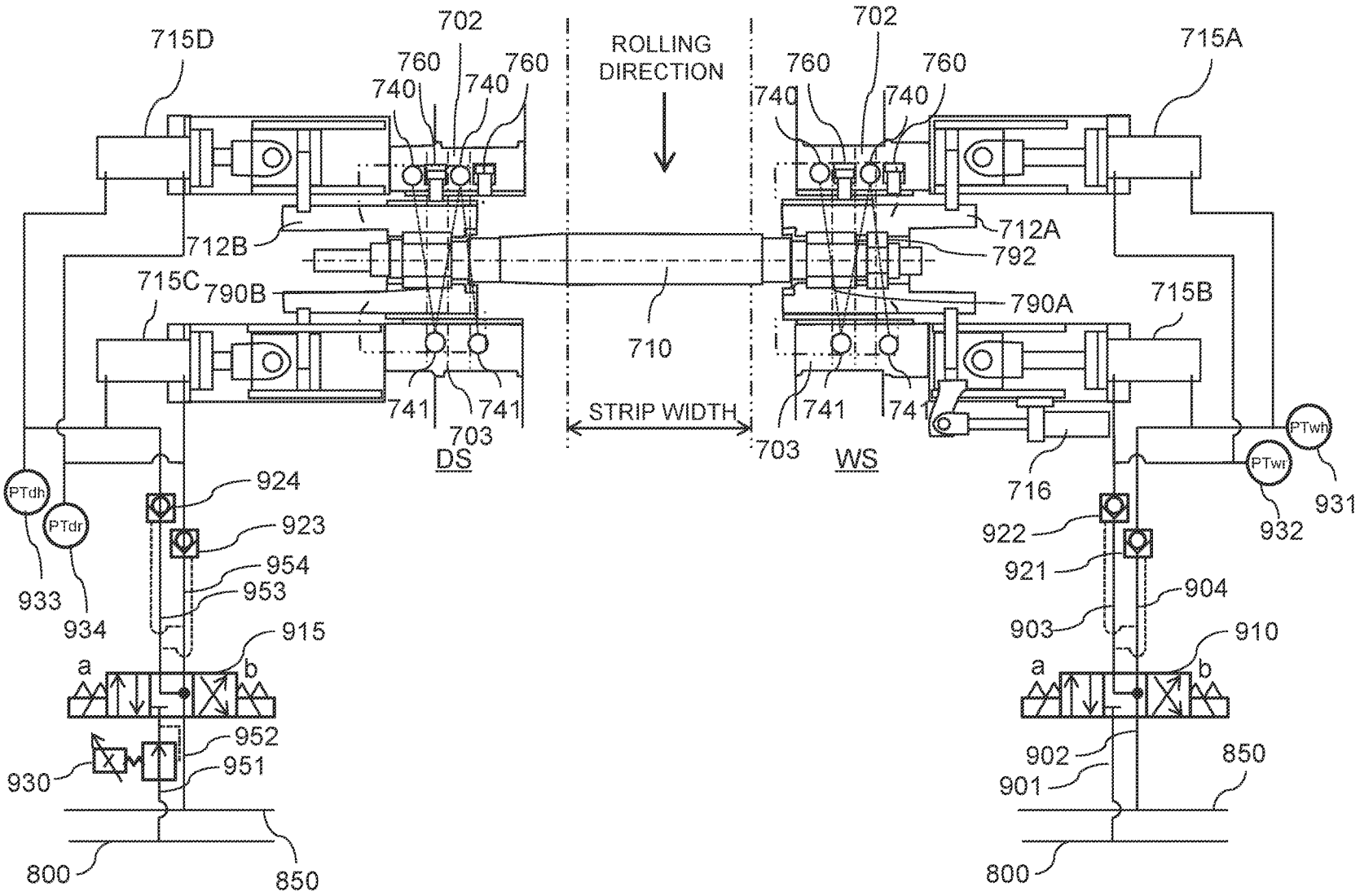
FIG. 11 is a plan view of assistance in explaining details of an upper work roll part in a rolling mill according to a modification of the second embodiment.

A rolling mill, a rolling mill control method, and a thrust force supporting method in the rolling mill according to a second embodiment of the present invention will be described with reference to FIG. 10 and FIG. 11. FIG. 10 is a plan view of assistance in explaining details of a work roll part in the rolling mill according to the present second embodiment. FIG. 11 is a plan view of assistance in explaining details of a work roll part in a rolling mill according to a modification of the second embodiment.

As shown in FIG. 10, on the work side of the driving system of the shift cylinders 715A, 715B, 715C, and 715D in the rolling mill according to the present embodiment, a work side solenoid selector valve 910 that regulates inflow/outflow amounts of oil is provided to the exit sides of a pressure line 901 branched from the pressure line 800 and a tank line 902 branched from the tank line 850.

On the drive side, a drive side solenoid selector valve 915 that regulates inflow/outflow amounts of oil is provided to the exit sides of a pressure line 951 branched from the pressure line 800 and a tank line 952 branched from the tank line 850.

The work side solenoid selector valve 910 and the drive side solenoid selector valve 915 have the same configuration as the solenoid selector valve 810 in the first embodiment.

In the present embodiment, as for operation of the work side solenoid selector valve 910 and the drive side solenoid selector valve 915, as shown in the following Table 1, preferably, both the work side solenoid selector valve 910 and the drive side solenoid selector valve 915 are a-energized when the shift direction of the upper work roll 710 is the work side, both the work side solenoid selector valve 910 and the drive side solenoid selector valve 915 are b-energized when the shift direction is the drive side, and the work side solenoid selector valve 910 and the drive side solenoid selector valve 915 are set to N as a neutral state when a shift is stopped.

In addition, when switching is performed, the work side solenoid selector valve 910 and the drive side solenoid selector valve 915 are preferably switched to a-energization, b-energization, or the neutral state at the same time. When a-energization and b-energization are reversed between the work side and the drive side, forces in opposite directions occur, thus decreasing the effect of the original function of reducing the thrust resistance force. It is therefore preferable to perform the same a-energization or b-energization simultaneously. The shift cylinders 715A and 715B on the work side and the shift cylinders 715C and 715D on the drive side can thereby receive a force necessary for a shift in a distributed manner at least at a time of a work side direction shift or at a time of a drive side direction shift.

Incidentally, these conditions are set for a case where the work side solenoid selector valve 910 and the drive side solenoid selector valve 915 are of the same specifications. In a case where the work side solenoid selector valve 910 and the drive side solenoid selector valve 915 have port configurations opposite from each other, a-energization and b-energization are preferably reversed between the work side and the drive side.

TABLE 1

| Shift direction | WS solenoid selector valve | DS solenoid selector valve |
|---|---|---|
| WS | a | a |
| DS | b | b |
| Stop | N | N |

In the present embodiment, when the work side solenoid selector valve 910 and the drive side solenoid selector valve 915 are a-energized, the rod sides of the shift cylinders 715A and 715B on the work side are connected to the pressure line 800 via a work side rod side pressure line 903 and the pressure line 901, so that a force in the work side direction acts on the thrust bearing 792, and the head sides of the shift cylinders 715C and 715D on the drive side are connected to the pressure line 800 via a drive side head side pressure line 953 and the pressure line 951, so that a force in the work side direction acts on the radial bearing 790B.

Then, the head sides of the shift cylinders 715A and 715B on the work side are connected to the tank line 850 via a work side head side pressure line 904 and the tank line 902, and the rod sides of the shift cylinders 715C and 715D on the drive side are connected to the tank line 850 via a drive side rod side pressure line 954 and the tank line 952. A shift force in the work side direction thereby occurs.

In addition, when the solenoid selector valve 810 is b-energized, the head sides of the shift cylinders 715A and 715B on the work side are connected to the pressure line 800 via the work side head side pressure line 904 and the pressure line 901, so that a force in the drive side direction acts on the thrust bearing 792, and the rod sides of the shift cylinders 715C and 715D on the drive side are connected to the pressure line 800 via the drive side rod side pressure line 954 and the pressure line 951, so that a force in the drive side direction acts on the radial bearing 790B.

Then, the rod sides of the shift cylinders 715A and 715B on the work side are connected to the tank line 850 via the work side rod side pressure line 903 and the tank line 902, and the head sides of the shift cylinders 715C and 715D on the drive side are connected to the tank line 850 via the drive side head side pressure line 953 and the tank line 952. A shift force in the drive side direction thereby occurs.

A pilot check valve 922 is provided to the work side rod side pressure line 903 on the downstream side of the work side solenoid selector valve 910, and a pilot check valve 921 is provided to the work side head side pressure line 904 on the downstream side of the work side solenoid selector valve 910.

Similarly, a pilot check valve 923 is provided to the drive side rod side pressure line 954 on the downstream side of the drive side solenoid selector valve 915, and a pilot check valve 924 is provided to the drive side head side pressure line 953 on the downstream side of the drive side solenoid selector valve 915.

Further, the work side rod side pressure line 903 is provided with a work side rod side pressure measuring device 932 that measures the pressures of the rod side spaces of the shift cylinders 715A and 715B, and the work side head side pressure line 904 is provided with a work side head side pressure measuring device 931 that measures the pressures of the head side spaces of the shift cylinders 715A and 715B. Similarly, the drive side rod side pressure line 954 is provided with a drive side rod side pressure measuring device 934 that measures the pressures of the rod side spaces of the shift cylinders 715C and 715D, and the drive side head side pressure line 953 is provided with a drive side head side pressure measuring device 933 that measures the pressures of the head side spaces of the shift cylinders 715C and 715D.

In such a hydraulic circuit, the control device 80 regulates the work side solenoid selector valve 910 and the drive side solenoid selector valve 915 on the basis of the respective pressures measured by the work side head side pressure measuring device 931, the work side rod side pressure measuring device 932, the drive side head side pressure measuring device 933, and the drive side rod side pressure measuring device 934.

In addition, the control device 80 regulates the work side solenoid selector valve 910 and the drive side solenoid selector valve 915 on the basis of the position of the upper work roll 710, which is measured by the position sensor 716.

Details of control thereof can, for example, be similar to those of control in a third embodiment to be described later.

Incidentally, in the circuit shown in FIG. 10, when a shift is performed and thereafter stopped during rolling, the upper work side bearing housing 712A is supported by the shift cylinders 715A and 715B on the work side, the upper drive side bearing housing 712B is supported by the shift cylinders 715C and 715D on the drive side, and the oil is sealed by the pilot check valves 921, 922, 923, and 924. Therefore, for a reason of elongation of the upper work roll 710 due to thermal expansion, a change in the direction of the thrust force acting on the roll set, or the like, only either the shift cylinders 715A and 715B on the work side or the shift cylinders 715C and 715D on the drive side may support the thrust reaction force.

In order to deal with an excessive load at the time, it is preferable to provide relief valves onto the work side rod side pressure line 903 and the work side head side pressure line 904 between the pilot check valves 921 and 922 and the shift cylinders 715A and 715B and onto the drive side rod side pressure line 954 and the drive side head side pressure line 953 between the pilot check valves 923 and 924 and the shift cylinders 715C and 715D, and thereby hold a pressure increase within the pipes to an allowable pressure of the pipes.

Other configurations and operations are substantially the same configurations and operations as those of the rolling mill, the rolling mill control method, and the thrust force supporting method in the rolling mill according to the foregoing first embodiment, and therefore details thereof will be omitted.

The rolling mill, the rolling mill control method, and the thrust force supporting method in the rolling mill according to the second embodiment of the present invention also provide effects substantially similar to those of the rolling mill, the rolling mill control method, and the thrust force supporting method in the rolling mill according to the foregoing first embodiment.

In addition, a balance between the pushing and pulling of the hydraulic cylinders on the operation side and the drive side, that is, load allocation can be adjusted by regulating the work side solenoid selector valve 910 and the drive side solenoid selector valve 915 on the basis of the respective pressures measured by the work side head side pressure measuring device 931, the work side rod side pressure measuring device 932, the drive side head side pressure measuring device 933, and the drive side rod side pressure measuring device 934. In a case where an allowable load differs because the bearings being used are different, for example, an effect is obtained in that a large thrust force can be supported on both the work side and the drive side without exceeding the allowable load of the bearings.

Further, the work side solenoid selector valve 910 and the drive side solenoid selector valve 915 are regulated also on the basis of the position of the upper work roll 710, which is measured by the position sensor 716. It is therefore possible to shift the upper work roll 710 while distributing the force to the shift cylinders 715A, 715B, 715C, and 715D on both the operation side and the drive side, and further easily set the position of the upper work roll 710 during a shift or after stopping the shift.

Incidentally, the form of the rolling mill according to the present embodiment is not limited to the form shown in FIG. 10. As shown in FIG. 11, it is possible to dispose a pressure control valve 930 on the entry side of the drive side solenoid selector valve 915 on the pressure line 951 on the drive side where the position sensor 716 is not disposed, and perform, by the pressure control valve 930, control equivalent to $\alpha a$ adjustment using a drive side servo valve 1070 in flowcharts shown in FIG. 13 and FIG. 14 according to a third embodiment to be described later. This also enables the adjustment of load allocation.

Figure 13:
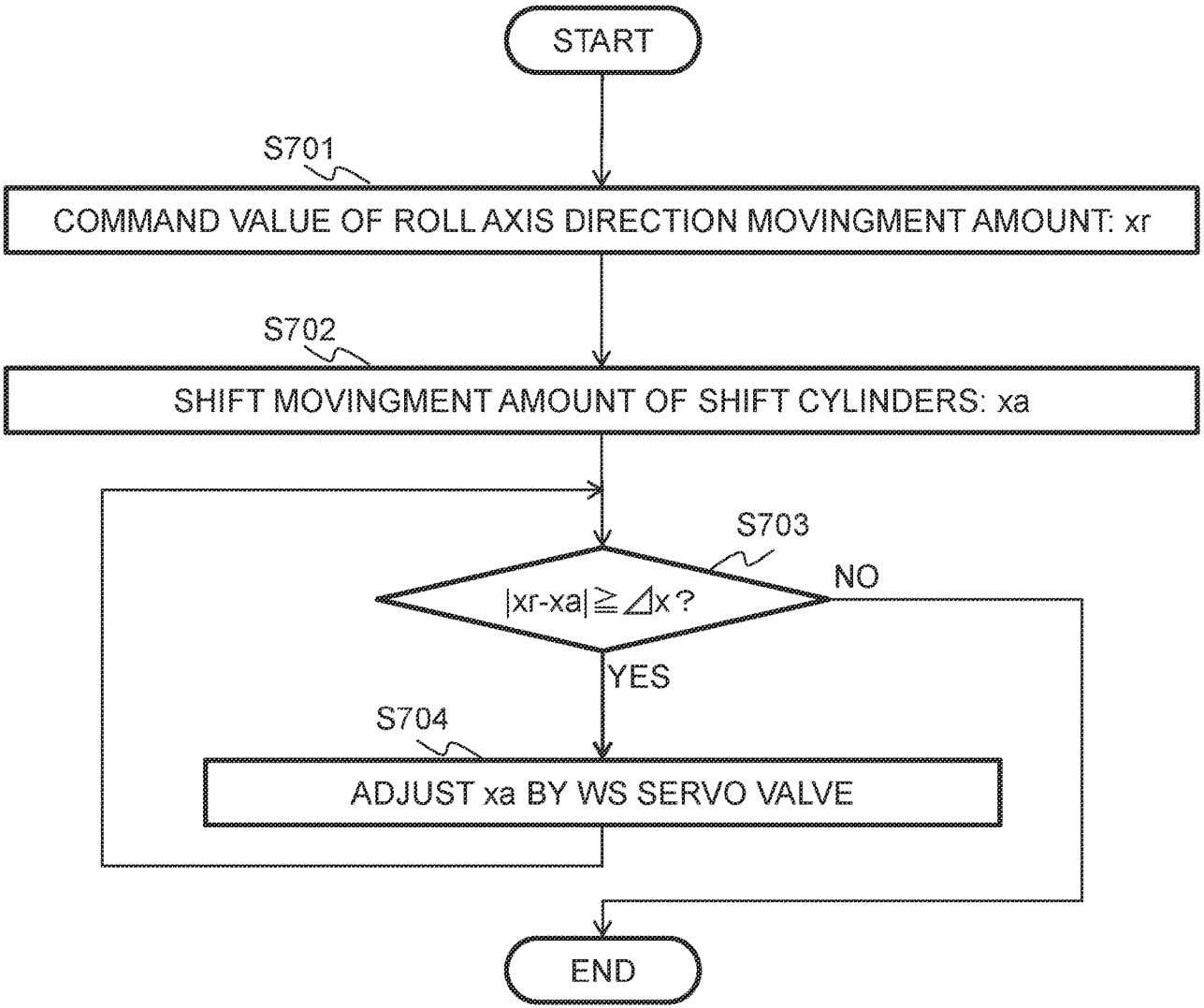
FIG. 13 is a flowchart showing a flow of roll axis direction positional adjustment in the rolling mill according to the third embodiment.
Figure 14:
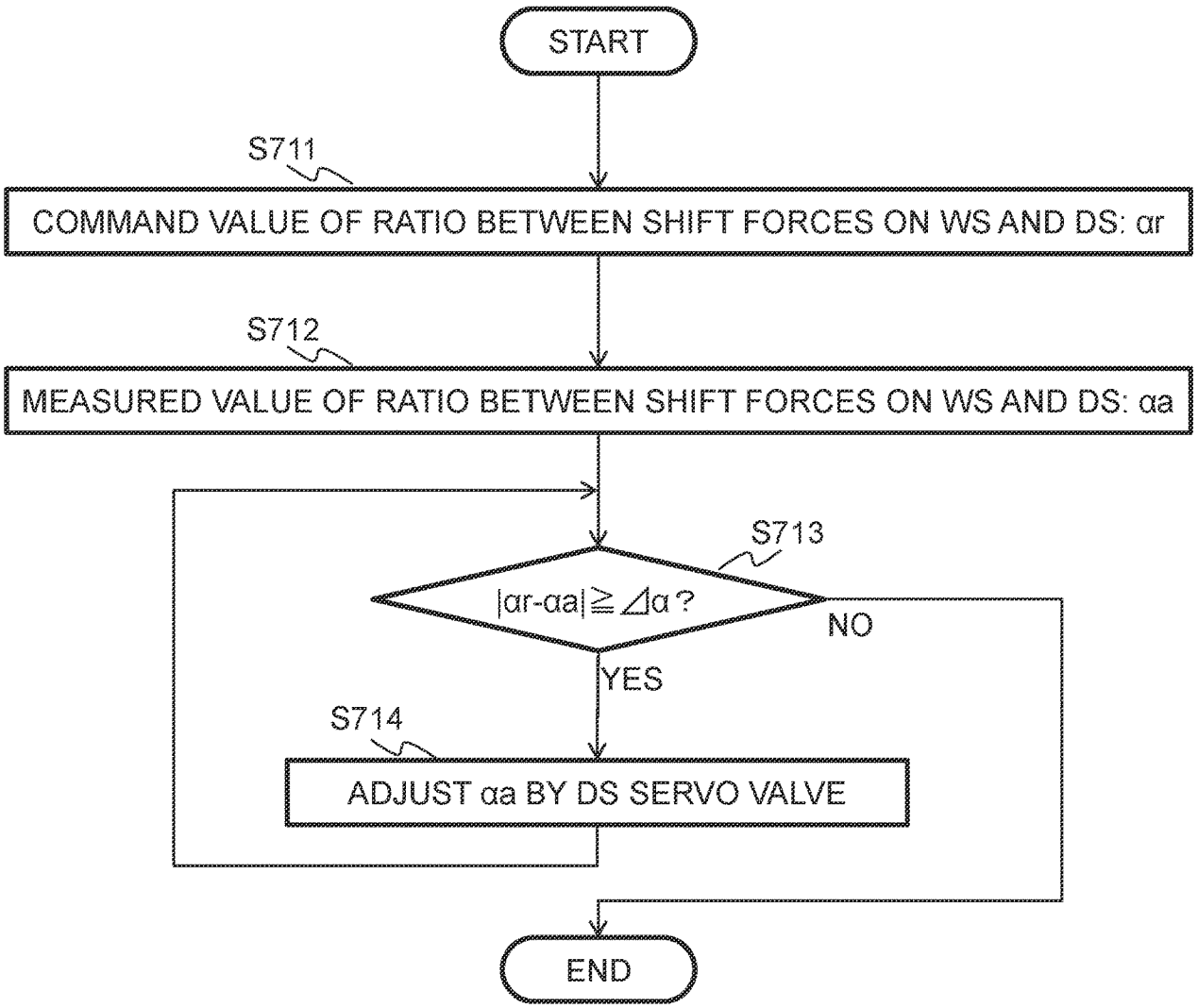
FIG. 14 is a flowchart showing a flow of shift force adjustment in the rolling mill according to the third embodiment.

In addition, the adjustment of load allocation is enabled also by installing a servo valve in place of the drive side solenoid selector valve 915 and the pressure control valve 930 in the configuration shown in FIG. 11, and perform adjustment equivalent to $\alpha a$ adjustment using the drive side servo valve 1070 in the flowcharts shown in FIG. 13 and FIG. 14.

Further, the configuration according to the present embodiment can be applied to the modifications of the first embodiment, which are shown in FIGS. 7 to 9.

Third Embodiment

Figure 12:
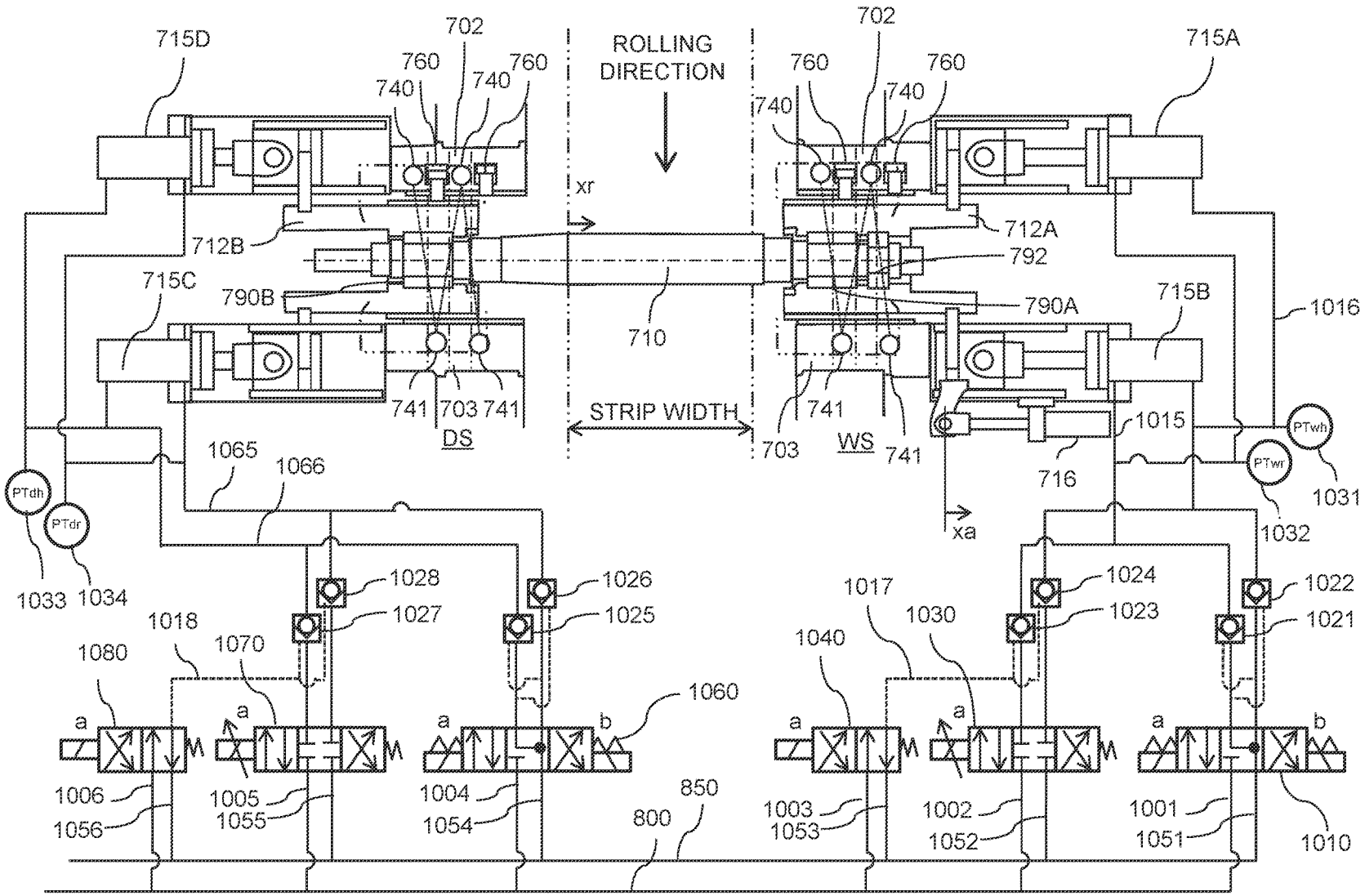
FIG. 12 is a plan view of assistance in explaining details of an upper work roll part in a rolling mill according to a third embodiment of the present invention.
Figure 15:
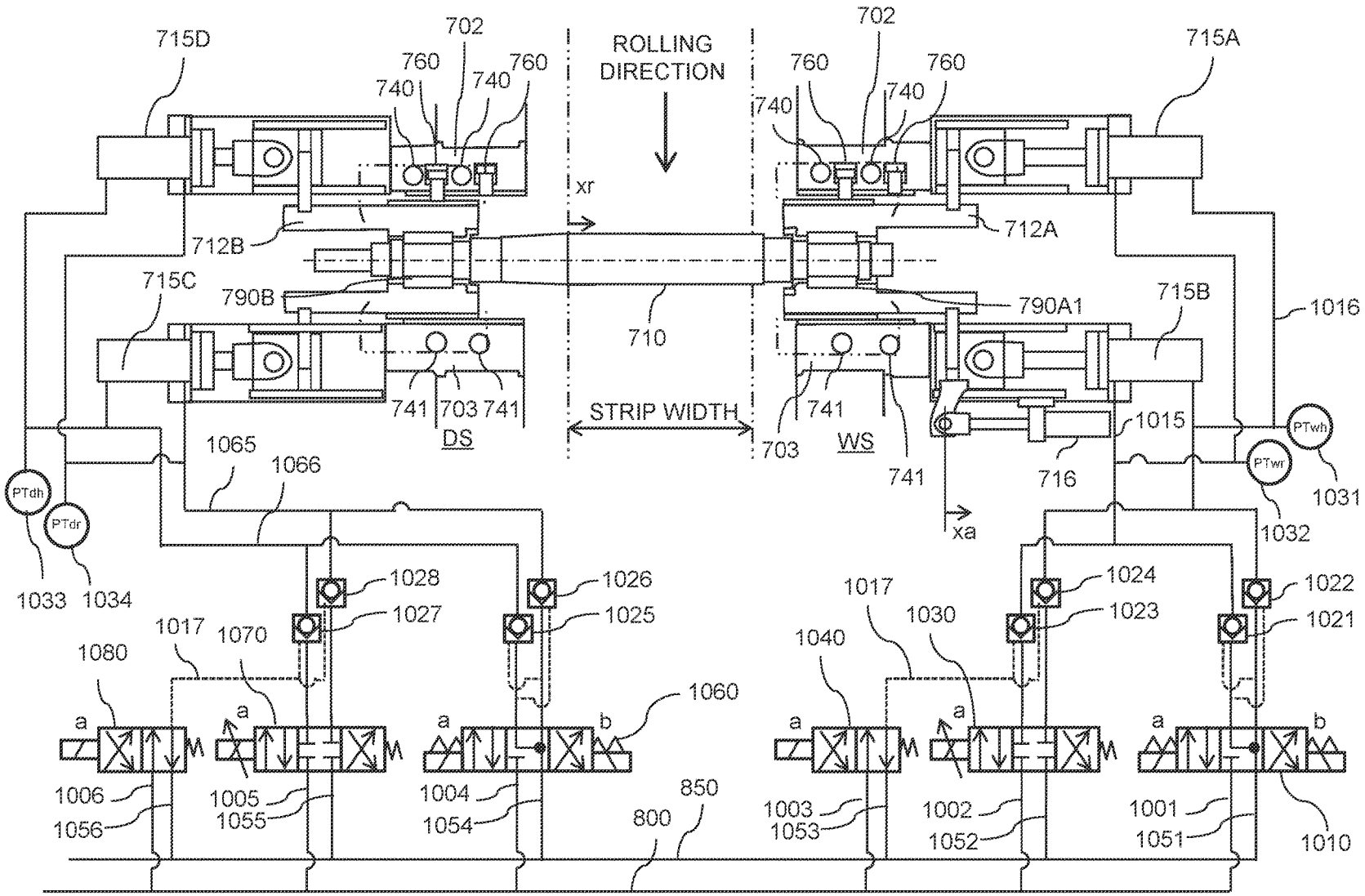
FIG. 15 is a plan view of assistance in explaining details of an upper work roll part in a rolling mill according to a modification of the third embodiment.

A rolling mill, a rolling mill control method, and a thrust force supporting method in the rolling mill according to a third embodiment of the present invention will be described with reference to FIGS. 12 to 15. FIG. 12 is a plan view of assistance in explaining details of an upper work roll part in the rolling mill according to the present third embodiment. FIG. 13 is a flowchart showing a flow of roll axis direction positional adjustment in the rolling mill according to the third embodiment. FIG. 14 is a flowchart showing a flow of shift force adjustment in the rolling mill according to the third embodiment. FIG. 15 is a plan view of assistance in explaining details of an upper work roll part in a rolling mill according to a modification of the third embodiment.

As shown in FIG. 12, on the work side of the driving system of the shift cylinders 715A, 715B, 715C, and 715D in the rolling mill according to the present embodiment, a first work side solenoid selector valve 1010 that regulates inflow/outflow amounts of oil is provided to the exit sides of a pressure line 1001 branched from the pressure line 800 and a tank line 1051 branched from the tank line 850.

In addition, a work side servo valve 1030 that regulates inflow/outflow amounts of oil is provided to the exit side of a pressure line 1002 branched from the pressure line 800 and a tank line 1052 branched from the tank line 850.

Further, a second work side solenoid selector valve 1040 that performs on/off regulation of a pilot check valve 1023 and a pilot check valve 1024 via a pilot line 1017 is provided to the exit sides of a pressure line 1003 branched from the pressure line 800 and a tank line 1053 branched from the tank line 850.

On the drive side, a first drive side solenoid selector valve 1060 that regulates inflow/outflow amounts of oil is provided to the exit sides of a pressure line 1004 branched from the pressure line 800 and a tank line 1054 branched from the tank line 850.

In addition, a drive side servo valve 1070 that regulates inflow/outflow amounts of oil is provided to the exit sides of a pressure line 1005 branched from the pressure line 800 and a tank line 1055 branched from the tank line 850.

Similarly, a second drive side solenoid selector valve 1080 that performs on/off regulation of a pilot check valve 1027 and a pilot check valve 1028 via a pilot line 1018 is provided to the exit sides of a pressure line 1006 branched from the pressure line 800 and a tank line 1056 branched from the tank line 850.

A pilot check valve 1021 is provided to a work side rod side pressure line 1015 on the downstream side of the first work side solenoid selector valve 1010, and a pilot check valve 1022 is provided to a work side head side pressure line 1016 on the downstream side of the first work side solenoid selector valve 1010.

Similarly, a pilot check valve 1025 is provided to a drive side head side pressure line 1066 on the downstream side of the first drive side solenoid selector valve 1060, and a pilot check valve 1026 is provided to a drive side rod side pressure line 1065 on the downstream side of the first drive side solenoid selector valve 1060.

Further, the work side rod side pressure line 1015 is provided with a work side rod side pressure measuring device 1032 that measures the pressures of the rod side spaces of the shift cylinders 715A and 715B, and the work side head side pressure line 1016 is provided with a work side head side pressure measuring device 1031 that measures the pressures of the head side spaces of the shift cylinders 715A and 715B.

Similarly, the drive side rod side pressure line 1065 is provided with a drive side rod side pressure measuring device 1034 that measures the pressures of the rod side spaces of the shift cylinders 715C and 715D, and the drive side head side pressure line 1066 is provided with a drive side head side pressure measuring device 1033 that measures the pressures of the head side spaces of the shift cylinders 715C and 715D.

In the present embodiment, operations of the first work side solenoid selector valve 1010, the work side servo valve 1030, the second work side solenoid selector valve 1040, the first drive side solenoid selector valve 1060, the drive side servo valve 1070, and the second drive side solenoid selector valve 1080 are as shown in the following Table 2.

TABLE 2

| Shift direction | Shift speed | State | WS first solenoid selector valve | WS second solenoid selector valve | WS servo valve | DS first solenoid selector valve | DS second solenoid selector valve | DS servo valve |
|---|---|---|---|---|---|---|---|---|
| WS | High speed | Not during rolling | a | N | N | a | N | N |
| | Low speed | During rolling | N | a | on | N | a | on |
| DS | High speed | Not during rolling | b | N | N | b | N | N |
| | Low speed | During rolling | N | a | on | N | a | on |
| Stop | | Not during rolling | N | N | N | N | N | N |
| | | During rolling 1 | N | a | on | N | a | on |
| | | During rolling 2 | N | N | N | N | N | N |

A high shift speed at which only the first work side solenoid selector valve 1010 and the first drive side solenoid selector valve 1060 are a-energized or b-energized is used not during rolling. For example, the high shift speed is used when the upper work roll 710 is desired to be shifted at high speed, for example when the upper work roll 710 is moved in the axial direction within the rolling mill for roll rearrangement. The high shift speed is set at about 20 [mm/s], for example.

A low shift speed at which the work side servo valve 1030, the second work side solenoid selector valve 1040, the drive side servo valve 1070, and the second drive side solenoid selector valve 1080 are used is used when the upper work roll 710 is shifted during rolling. In this timing, a rolling load acts, and therefore shift resistances between the upper work roll 710 and the rolled material 5 and between the upper work roll 710 and the upper intermediate roll 720 are increased as the shift speed becomes faster. Therefore, a shift is performed at a low speed during rolling. The low shift speed is set at 2.0 [mm/s] or lower, for example.

Shifts during rolling are performed on the upper and lower sides at the same time; for example, the upper work roll 710 is shifted in the work side direction and the lower work roll 711 is shifted in the drive side direction at the same time. The shift speeds are made to be substantially the same, and the upper work roll 710 and the lower work roll 711 are shifted such that the upper work roll 710 and the lower work roll 711 are in a point-symmetric state with respect to the center of the rolled material 5 (or the pass center of the rolling mill) also during shift operation. When the point-symmetric state is disturbed during rolling, leveling changes, one side in the width direction of the rolled material 5 is rolled more than another side, thus forming a wedge shape, and consequently off-center tends to be caused. The upper work roll 710 and the lower work roll 711 are moved in the point-symmetric state in order to avoid such unstable rolling.

Both when the shift direction of the upper work roll 710 is the work side and when the shift direction of the upper work roll 710 is the drive side, the second work side solenoid selector valve 1040 and the second drive side solenoid selector valve 1080 are each a-energized.

The work side servo valve 1030 and the drive side servo valve 1070 are each driven to be ON. At this time, the position sensor 716 senses the position of the upper work roll 710, and the position and a moving speed are determined from a result of the position sensing, and are regulated to be a target position and a target moving speed.

That is, the control device 80 in the present embodiment regulates the work side servo valve 1030, the second work side solenoid selector valve 1040, the drive side servo valve 1070, and the second drive side solenoid selector valve 1080 on the basis of the respective pressures measured by the work side head side pressure measuring device 1031, the work side rod side pressure measuring device 1032, the drive side head side pressure measuring device 1033, and the drive side rod side pressure measuring device 1034.

In addition, the control device 80 regulates the work side servo valve 1030, the second work side solenoid selector valve 1040, the drive side servo valve 1070, and the second drive side solenoid selector valve 1080 also on the basis of the position of the upper work roll 710, which is measured by the position sensor 716.

More specifically, a shift force on the work side is obtained from measured values of the work side head side pressure measuring device 1031 provided to the work side head side pressure line 1016 shown in FIG. 12 and the work side rod side pressure measuring device 1032 provided to the work side rod side pressure line 1015. A shift force Fw on the work side is obtained from (rod side pressure PTwr of the shift cylinders 715A and 715B on the work side)×(rod side area Awr of the shift cylinders 715A and 715B on the work side)−(head side pressure PTwh of the shift cylinders 715A and 715B on the work side)×(head side area Awh of the shift cylinders 715A and 715B on the work side).

In addition, on the drive side, a shift force on the drive side is obtained from measured values of the drive side head side pressure measuring device 1033 provided to the drive side head side pressure line 1066 and the drive side rod side pressure measuring device 1034 provided to the drive side rod side pressure line 1065. A shift force Fd on the drive side is obtained from (head side pressure PTdh of the shift cylinders 715C and 715D on the drive side)×(head side area Adh of the shift cylinders 715C and 715D on the drive side)−(rod side pressure PTdr of the shift cylinders 715C and 715D on the drive side)×(rod side area Adr of the shift cylinders 715C and 715D on the drive side).

Thereafter, the drive side servo valve 1070 performs adjustment such that the obtained shift force on the work side and the obtained shift force on the drive side each have a same force magnitude and a same force direction. Here, it is also possible to change the shift forces optionally while the shift forces on the work side and the drive side have the same direction.

Thus, the work side servo valve 1030 is used for positioning, and the drive side servo valve 1070 is used for shift load allocation adjustment.

A flow of roll axis direction positional adjustment will next be described with reference to FIG. 13.

First, the control device 80 receives an input of a command value xr of a roll axis direction movement amount (step S701), and receives an input of a shift movement amount (that is, a measured value of the position sensor 716) xa of the shift cylinders 715A, 715B, 715C, and 715D at a present point in time (step S702). The command value xr of the roll axis direction movement amount is specified according to wear in the roll or in order to make the position of a roll tapered portion with respect to a strip width end portion a desired position.

Next, the control device 80 determines whether or not an absolute value $|xr-xa|$ of a difference between the command value xr input in step S701 and the shift movement amount xa input in step S702 is equal to or more than a predetermined difference value $\Delta x$ (step S703). When the control device 80 determines that the absolute value $|xr-xa|$ is equal to or more than the difference value $\Delta X$, the control device 80 advances the processing to step S704, adjusts the shift movement amount xa by the work side servo valve 1030 (step S704), and then returns the processing to step S703. When the control device 80 determines that the absolute value $|xr-xa|$ is smaller than the difference value $\Delta x$, on the other hand, the control device 80 ends the processing.

This positioning adjustment is performed such that xa is automatically adjusted by the work side servo valve 1030 when $|xr-xa| \geq \Delta x$ at a time of a shift during rolling as shown in Table 2 or "During rolling 1" as shown in Table 2 even at a time of a stop. Incidentally, a value of ±5 [mm] or the like, for example, is set as $\Delta x$.

Incidentally, the roll axis direction position can be adjusted also by using the work side solenoid selector valve 910 on the side where the position sensor 716 is present in FIG. 10, and performing control equivalent to the adjustment of the shift movement amount xa by the work side servo valve 1030 in the flowchart shown in FIG. 13 through the switching of the work side solenoid selector valve 910.

A flow of shift force adjustment will next be described with reference to FIG. 14.

First, the control device 80 receives an input of a command value $\alpha r$ of a ratio between the shift forces on the work side and the drive side as a command value of shift load allocation itself in Table 2 (step S711), and obtains a measured value $\alpha a$ of the ratio between the shift forces on the work side and the drive side, which is obtained from (ratio $\alpha w$ (=Fw/Ftt) of the shift force on the work side)/(ratio $\alpha d$ (=Fd/Ftt) of the shift force on the drive side), where a sum of the shift force Fw on the work side and the shift force Fd on the drive side is Ftt (step S712).

Next, the control device 80 determines whether or not an absolute value $|\alpha r-\alpha a|$ of a difference between the command value $\alpha r$ input in step S711 and the measured value aa obtained in step S712 is equal to or more than a difference $\Delta\alpha$ (for example, a setting is made such that $\Delta\alpha=0.1\times\alpha a$ or the like) between the command value and the measured value of the ratio between the shift forces on the work side and the drive side (step S713). When the control device 80 determines that the absolute value $|\alpha r-\alpha a|$ is equal to or more than the difference $\Delta\alpha$, the control device 80 advances the processing to step S714, makes an adjustment by the drive side servo valve 1070 such that the measured value $\alpha a$ is decreased (step S714), and then returns the processing to step S713. When the control device 80 determines that the absolute value $|\alpha r-\alpha a|$ is smaller than the difference $\Delta\alpha$, on the other hand, the control device 80 ends the processing.

This shift force adjustment is performed at a time of a shift during rolling as shown in Table 2 or "During rolling 1" as shown in Table 2 even at a time of a stop. Load allocation is thus adjusted.

In addition, the lower work roll 711 opposite in the vertical direction from the upper work roll 710 shown in FIG. 12 is shifted in a manner point-symmetric to the upper work roll 710. Also in the case of the lower work roll 711, as in FIG. 12, the servo valve on the work side is used for positioning, and the servo valve on the drive side is used for shift load allocation adjustment. In addition, it suffices for one of the servo valves on the work side or the drive side to be for positioning, and it suffices for the other servo valve to be for shift load allocation adjustment. Either of the work side and the drive side may be for positioning or for shift load allocation adjustment.

During a stop, one of various kinds of states in three rows in a lower part of Table 2 can be assumed. N as a neutral state is assumed when rolling is not being performed. "During rolling 1" in Table 2, a servo valve is used to retain the position, so that the servo valve for positioning performs position retention, and the servo valve for shift load allocation adjustment performs shift load allocation. "During rolling 2" in Table 2, the pressures of the shift cylinders 715A, 715B, 715C, and 715D are simply set in a sealed state without the use of the work side servo valve 1030 and the drive side servo valve 1070.

Other configurations and operations are substantially the same configurations and operations as those of the rolling mill, the rolling mill control method, and the thrust force supporting method in the rolling mill according to the foregoing first embodiment, and therefore details thereof will be omitted.

The rolling mill, the rolling mill control method, and the thrust force supporting method in the rolling mill according to the third embodiment of the present invention also provide effects substantially similar to those of the rolling mill, the rolling mill control method, and the thrust force supporting method in the rolling mill according to the foregoing first embodiment.

In addition, in the first embodiment, there is an advantage of being able to provide a simple hydraulic system in which switching between the work side and the drive side can be performed by one solenoid selector valve 810. On the other hand, although a certain load allocation is performed, it is not possible to adjust the measured value $\alpha a$ of the ratio between the shift forces on the work side and the drive side as in the flowcharts as shown in FIG. 13 and FIG. 14.

In a case where the bearings on the work side and the drive side are the same and thus the bearings have a same load resistance life, for example, the thrust reaction forces on both sides may be made to be substantially the same. In addition, even in a case where the bearings on the work side and the drive side are different, and have different load resistance lives, setting a bearing ratio between one thrust reaction force and the other thrust reaction force such that both lives become substantially the same is also one method. In the present embodiment, a configuration can be adopted in which consideration is given also to the load resistance lives of such bearings.

Incidentally, as shown in FIG. 15, it is possible to exclude the thrust bearing 792 on the work side shown in FIG. 12, make also a radial bearing 790A1 on the work side a four-row tapered bearing, and thereby adopt the same structure as the radial bearing 790B on the drive side.

According to this, it is possible to reduce the thrust reaction force on the work side by sharing the thrust reaction forces, and resist the thrust reaction force by the same bearing structure as that on the drive side. Thus, the kinds of bearings can be reduced, and a maintenance load can be reduced.

Further, load allocation can be adjusted also by arranging a solenoid selector valve and a pressure control valve in place of the drive side servo valve 1070 in FIG. 12, and performing, by the pressure control valve, adjustment equivalent to the adjustment of the measured value $\alpha a$ of the ratio between the shift forces on the work side and the drive side by the drive side servo valve 1070 in the flowchart shown in FIG. 14.

In addition, the side on which shift load allocation adjustment is performed may not be the side of the drive side servo valve 1070, but another method can also be adopted. For example, there is a method of reducing the shift force on the positioning side by enabling a certain shift force to be supplied when the shift force on the positioning side exceeds a certain value.

Further, in Table 2, the first work side solenoid selector valve 1010 and the first drive side solenoid selector valve 1060 are used when the shift speed is a high speed. However, the work side servo valve 1030 and the drive side servo valve 1070 can be used at all times including times when the shift speed is a high speed, and the first work side solenoid selector valve 1010 and the first drive side solenoid selector valve 1060 can be set as backups in case of the occurrence of an abnormality in the work side servo valve 1030 and the drive side servo valve 1070.

In addition, the configuration of the present embodiment can be applied to the modifications of the first embodiment, which are shown in FIGS. 7 to 9.

<Others>

It is to be noted that the present invention is not limited to the foregoing embodiments, but includes various modifications. The foregoing embodiments have been described in detail in order to describe the present invention in an easily understandable manner, and are not necessarily limited to embodiments including all of the described configurations.

In addition, a part of a configuration of a certain embodiment can be replaced with a configuration of another embodiment, and a configuration of another embodiment can be added to a configuration of a certain embodiment. In addition, for a part of a configuration of each embodiment, another configuration can be added, deleted, or substituted.

DESCRIPTION OF REFERENCE CHARACTERS

1: Rolling equipment
5: Rolled material
30: First stand (rolling mill)
40: Second stand (rolling mill)
50: Third stand (rolling mill)
60: Fourth stand (rolling mill)
70: Fifth stand (rolling mill)
80: Control device
90: Hydraulic device
201: Straight line
202: Straight line
203: Thrust resistance force
204: Straight line
205: Straight line
700: Housing
702: Entry side fixed member
703: Exit side fixed member
710: Upper work roll (work roll)
711: Lower work roll (work roll)
712: Upper work roll bearing housing
712A: Upper work side bearing housing
712B: Upper drive side bearing housing
713: Lower work roll bearing housing
713A: Bearing housing
713B: Bearing housing
714A, 714B, 714C, 714D: Connecting member

715: Shift cylinder (work side and drive side thrust force supporting devices)
715A, 715B: Shift cylinder (operation side thrust force supporting device)
715C, 715D: Shift cylinder (drive side thrust force supporting device)
716: Position sensor 717: Shift cylinder (work side and drive side thrust force supporting devices)
718, 719: Shift cylinder
720: Upper intermediate roll
721: Lower intermediate roll
722: Upper intermediate roll bearing housing
723: Lower intermediate roll bearing housing
730: Upper back-up roll
731: Lower back-up roll
732: Upper back-up roll bearing housing
733: Lower back-up roll bearing housing
740, 741, 742, 743: Upper work roll bending cylinder
744, 745, 746, 747: Lower work roll bending cylinder
750, 751: Upper intermediate roll bending cylinder
752, 753: Lower intermediate roll bending cylinder
760: Upper work roll bearing housing backlash removing cylinder
762: Lower work roll bearing housing backlash removing cylinder
771: Upper intermediate roll bearing housing backlash removing cylinder
773: Lower intermediate roll bearing housing backlash removing cylinder
780: Upper back-up roll bearing housing backlash removing cylinder
782: Lower back-up roll bearing housing backlash removing cylinder
790A, 790A1, 790B: Radial bearing
792: Thrust bearing
794: Thrust force transmitting member
800, 801, 803, 901, 951, 1001, 1002, 1003, 1004, 1005, 1006: Pressure line (pipe)
802, 850, 902, 952, 1051, 1052, 1053, 1054, 1055, 1056: Tank line
804, 953, 1066: Drive side head side pressure line (pipe)
805, 903, 1015: Work side rod side pressure line (pipe)
806, 954, 1065: Drive side rod side pressure line (pipe)
807, 904, 1016: Work side head side pressure line (pipe)
810: Solenoid selector valve (inflow/outflow oil amount adjusting unit)
821, 822, 921, 922, 923, 924, 1021, 1022, 1023, 1024, 1025, 1026, 1027, 1028: Pilot check valve
910: Work side solenoid selector valve (inflow/outflow oil amount adjusting unit)
915: Drive side solenoid selector valve (inflow/outflow oil amount adjusting unit)
930: Pressure control valve
931, 1031: Work side head side pressure measuring device
932, 1032: Work side rod side pressure measuring device
933, 1033: Drive side head side pressure measuring device
934, 1034: Drive side rod side pressure measuring device
1010: First work side solenoid selector valve (inflow/outflow oil amount adjusting unit)
1017, 1018: Pilot line
1030: Work side servo valve (inflow/outflow oil amount adjusting unit)
1040: Second work side solenoid selector valve (inflow/outflow oil amount adjusting unit)
1060: First drive side solenoid selector valve (inflow/outflow oil amount adjusting unit)
1070: Drive side servo valve (inflow/outflow oil amount adjusting unit)
1080: Second drive side solenoid selector valve (inflow/outflow oil amount adjusting unit)

The invention claimed is:

1. A rolling mill comprising:
a work roll;
bearings that are provided on an operation side and a drive side of the work roll, and support the work roll;
an operation side thrust force supporting device that is provided on the operation side of the work roll, and applies forces in both directions of the operation side and the drive side to the bearing on the operation side; and
a drive side thrust force supporting device that is provided on the drive side of the work roll, and applies forces in both directions of the operation side and the drive side to the bearing on the drive side,
the operation side thrust force supporting device and the drive side thrust force supporting device each applying a force in a same direction to the bearing when the work roll is not shifted in an axial direction at least during rolling.

2. The rolling mill according to claim 1, wherein
the operation side thrust force supporting device and the drive side thrust force supporting device are controlled such that the drive side thrust force supporting device applies a force of pulling to the drive side to the bearing when the operation side thrust force supporting device applies a force of pushing to the drive side to the bearing, and such that the operation side thrust force supporting device applies a force of pulling to the operation side to the bearing when the drive side thrust force supporting device applies a force of pushing to the operation side to the bearing.

3. The rolling mill according to claim 1, wherein
a pushing force applied by the operation side thrust force supporting device or the drive side thrust force supporting device is made larger than a pulling force applied by the operation side thrust force supporting device or the drive side thrust force supporting device.

4. The rolling mill according to claim 1, wherein
the operation side thrust force supporting device and the drive side thrust force supporting device include a hydraulic cylinder having a cylinder slid by an inflow or an outflow of oil into or from each of a head side space and a rod side space, and
the rolling mill further includes
pipes into or from which the oil flows,
pressure measuring devices that are provided to the pipes, and measure respective pressures of the head side spaces and the rod side spaces,
inflow/outflow oil amount adjusting units that are provided to the pipes, and regulate inflow/outflow amounts of the oil, and
a control device that regulates at least one inflow/outflow oil amount adjusting unit on the operation side or the drive side on a basis of the respective pressures measured by the pressure measuring devices on the operation side and the pressure measuring devices on the drive side.

5. The rolling mill according to claim 1, wherein
the operation side thrust force supporting device and the drive side thrust force supporting device include a hydraulic cylinder having a cylinder slid by an inflow or an outflow of oil into or from each of a head side space and a rod side space, and the rolling mill further includes pipes into or from which the oil flows, a position sensor that senses a position of the work roll, and inflow/outflow oil amount adjusting units that are provided to the pipes, and regulate inflow/outflow amounts of the oil, and a control device that regulates at least one inflow/outflow oil amount adjusting unit on the operation side or the drive side on a basis of the position of the work roll, the position being measured by the position sensor.

6. The rolling mill according to claim 4, wherein the rolling mill further includes a position sensor that senses a position of the work roll, and the control device regulates the at least one inflow/outflow oil amount adjusting unit on the operation side or the drive side also on a basis of the position of the work roll, the position being measured by the position sensor.

7. The rolling mill according to claim 4, wherein the rod side space of each of the hydraulic cylinder on the operation side and the hydraulic cylinder on the drive side is disposed on a side close to a rolled material.

8. The rolling mill according to claim 1, wherein letting $D_w$ be a diameter of the work roll, and letting $L_B$ be a maximum rolling strip width of a rolled material, the work roll satisfies a condition that $D_w/L_B$ is 0.28 or less.

9. A control method of a rolling mill including a work roll, bearings that are provided on an operation side and a drive side of the work roll, and support the work roll, an operation side thrust force supporting device that is provided on the operation side of the work roll, and applies forces in both directions of the operation side and the drive side to the bearing on the operation side, and a drive side thrust force supporting device that is provided on the drive side of the work roll, and applies forces in both directions of the operation side and the drive side to the bearing on the drive side, the control method comprising:

causing the operation side thrust force supporting device and the drive side thrust force supporting device each to apply a force in a same direction to the bearing when the work roll is not shifted in an axial direction at least during rolling.

10. The control method of the rolling mill according to claim 9, wherein the drive side thrust force supporting device is caused to apply a force of pulling to the drive side to the bearing when the operation side thrust force supporting device applies a force of pushing to the drive side to the bearing, and the operation side thrust force supporting device is caused to apply a force of pulling to the operation side to the bearing when the drive side thrust force supporting device applies a force of pushing to the operation side to the bearing.

11. A thrust force supporting method in a rolling mill including a work roll, bearings that are provided on an operation side and a drive side of the work roll, and support the work roll, an operation side thrust force supporting device that is provided on the operation side of the work roll, and applies forces in both directions of the operation side and the drive side to the bearing on the operation side, and a drive side thrust force supporting device that is provided on the drive side of the work roll, and applies forces in both directions of the operation side and the drive side to the bearing on the drive side, the thrust force supporting method comprising:

by the operation side thrust force supporting device and the drive side thrust force supporting device, applying a force in a same direction to the bearing when the work roll is not shifted in an axial direction at least during rolling.

12. The thrust force supporting method in the rolling mill according to claim 11, wherein the drive side thrust force supporting device applies a force of pulling to the drive side to the bearing when the operation side thrust force supporting device applies a force of pushing to the drive side to the bearing, and the operation side thrust force supporting device applies a force of pulling to the operation side to the bearing when the drive side thrust force supporting device applies a force of pushing to the operation side to the bearing.

* * * * *